US005513841A

United States Patent [19]

Takagi

[11] Patent Number: 5,513,841

[45] Date of Patent: May 7, 1996

[54] GOLF DRIVING RANGE SYSTEM

[76] Inventor: Hideaki Takagi, No. 13-9, 1-Chome Ao-Gein, Minoo, Osaka, 562, Japan

[21] Appl. No.: 326,869

[22] Filed: Oct. 21, 1994

[30] Foreign Application Priority Data

| | | | |
|---|---|---|---|
| Oct. 22, 1993 | [JP] | Japan | 5-057260 U |
| Dec. 9, 1993 | [JP] | Japan | 6-309475 |
| Sep. 16, 1994 | [JP] | Japan | 6-222123 |

[51] Int. Cl.[6] ..... A63B 69/36

[52] U.S. Cl. ..... 473/134; 473/153; 473/154; 473/166; 473/168

[58] Field of Search ..... 273/35 B, 181 R, 273/182 R, 182 A

[56] References Cited

U.S. PATENT DOCUMENTS

| | | | |
|---|---|---|---|
| 4,171,812 | 10/1979 | Marsin | 273/182 R X |
| 5,370,389 | 12/1994 | Reising | 273/35 B |

*Primary Examiner*—William H. Grieb
*Attorney, Agent, or Firm*—Crutsinger & Booth

[57] ABSTRACT

A golf driving range system for golfers to practice their driving skills is provided. The driving range system includes a plurality of tee boxes. Each tee box has a renewable ball stock and an automatic golf ball tee-up machine. The balls in the ball stock of each tee box have identifying characteristics for relating the balls to the particular tee box. The system has a yard and ball return gutters. The yard has sloped surfaces to cause any golf balls landing on the yard to roll toward the ball return gutters. At least one target is positioned in the yard. The target has a winning ball identification apparatus for sensing the identifying characteristics of a ball hitting the target and relaying this information to a scoring device. The ball return gutters deliver balls landing in the yard to a ball distribution apparatus, which has a return ball identification apparatus for sensing the identifying characteristics of a ball and distributing the ball back to the renewable ball stocks of the tee boxes. The identifying characteristics for the golf balls can include, for example, color, symbols, bar codes, magnetism, or any combination thereof. The ball identification apparatus include suitable devices for detecting color, graphic images, bar codes, or magnetism, depending on which type of identifying characteristics are employed.

21 Claims, 20 Drawing Sheets

(a)

(b)

GOLF DRIVING RANGE SYSTEM

BACKGROUND OF THE INVENTION

The popularity of golf as a recreational and sporting activity has been increasing very steadily. In recent times, there has been a remarkable increase in the popularity of the game among women and young people. The increased demand for golf and driving range facilities and the diversification of the types of people playing golf is creating a need for new ways to play the game, particularly in crowded urban areas where golf course space is limited and costly. The increasing and new demands for a wider variety of golf driving range services has been motivating the industry to break from the conventional driving range operation of simply renting a tee box and practice balls. To meet the increasing demand and have a competitive edge, a golf driving range needs to provide improved services.

At most conventional driving ranges, a golfer pays an admission fee, rents a bucket of practice balls, takes up a tee box, and hits ball after ball aiming at fixed targets, for example, 100 yards, 150 yards, or 180 yards. The target area soon becomes littered with hundreds of golf balls, making it almost impossible to track the result of each shot. Periodically, grounds keepers sweep the target area to collect the accumulated balls for reuse.

Based on the increasing demand for driving ranges, some have started to bring in tee-up machines, golf ball collection vehicles, and golf ball vending machines to handle large numbers of balls used at a busy driving range in order to improve efficiency and attract new customers. Recently, there have been introduced movable targets that have a flag pole mounted on a truck. A golfer can move the truck farther or closer to the tee box by remote control. The distance from the tee box to the movable target is displayed to the golfer, who can use the information to select a club and practice stokes of the desired range.

But while these devices increase the efficiency of the driving range, a driving range practice session still tends to be dull and uninteresting, lacking most of the challenge and excitement of the real game. The golfer hits ball after ball toward the target, but has little ability to determine how good each shot actually was. The driving range practice session usually captures much less interest and concentration of the golfer, which tends to reduce its effectiveness for improving the golfers skill at the real game. Thus, there is a long-felt and growing need for ways to make the golf driving range more interesting and challenging to the golfer.

SUMMARY OF THE INVENTION

According to the invention, a golf driving range system for golfers to practice their driving skills is provided. The driving range system includes a plurality of tee boxes. Each tee box has a renewable ball stock and an automatic golf ball tee-up machine. The balls in the ball stock of each tee box have identifying characteristics for relating the balls to the particular tee box. The system has a yard and ball return gutters. The yard has sloped surfaces to cause any golf balls landing on the yard to roll toward the ball return gutters. At least one target is positioned in the yard. The target has a winning ball identification apparatus for sensing the identifying characteristics of a ball hitting the target and relaying this information to a scoring device. The ball return gutters deliver balls landing in the yard to a ball distribution apparatus, which has a return ball identification apparatus for sensing the identifying characteristics of a ball and distributing the ball back to the renewable ball stocks of the tee boxes. The identifying characteristics for the golf balls can include, for example, color, symbols, bar codes, magnetism, or any combination thereof. The ball identification apparatus include suitable devices for detecting color, graphic images, bar codes, or magnetism, depending on which type of identifying characteristics are employed.

Accordingly, it is an object and purpose of the present invention to provide an improved golf driving range system. It is an object and purpose of the invention to provide an essentially automated driving range. It is also an object and purpose of the invention to provide immediate feedback to the golfer regarding the practice session. Thus, a golfer will have more interest in the driving range practice, which may improve its usefulness for improving basic golf skills. It is a further object of the invention to provide a new element of sport and recreation to a golf driving range session. Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DETAILED DESCRIPTION OF PREFERRED EMBODIMENTS OF THE INVENTION

Figure 1:
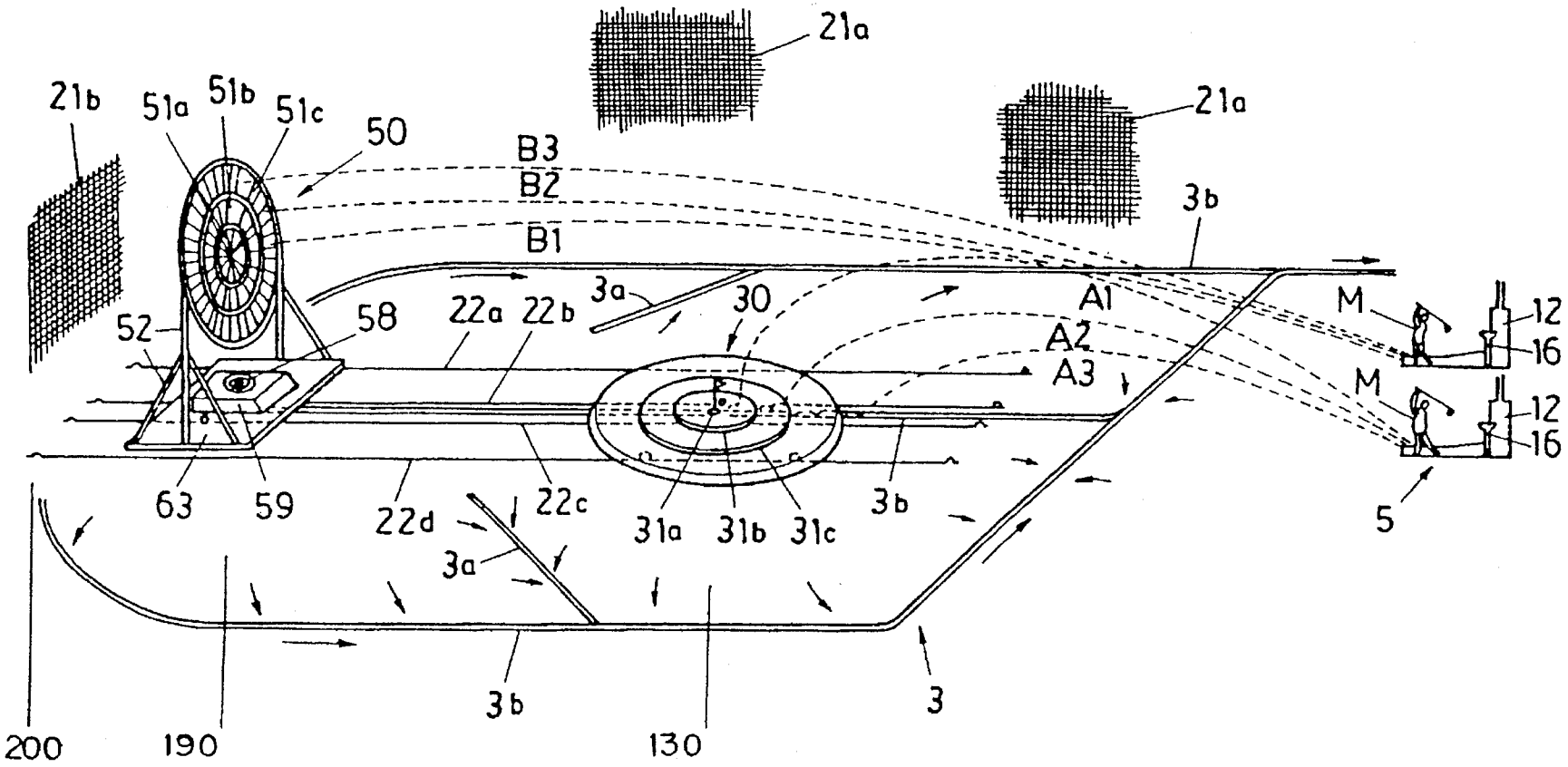
FIG. 1 is a view from an elevated side position of one preferred embodiment of a golf driving range system having a plurality of tee boxes, a yard with a ball collection gutter system, and a track system for movable targets simulating golf greens at various driving distances.
Figure 2:
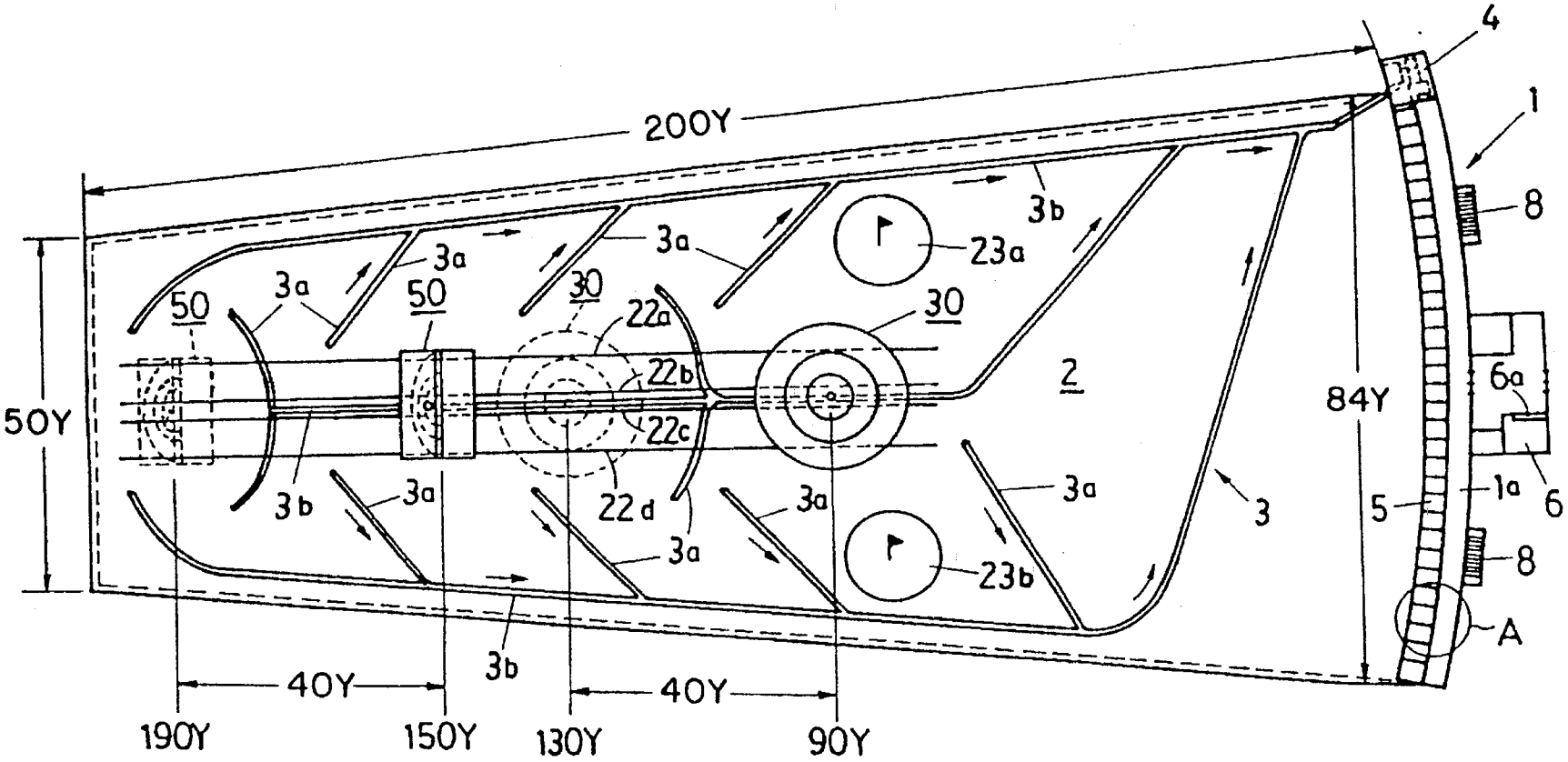
FIG. 2 is a top plan view of a larger golf driving range system similar to the system shown in FIG. 1, but having about thirty tee boxes in a tee-box facility and a larger yard with more elaborate gutter system for ball collection.

The basic concept and construction of the presently most preferred embodiments of the invention for a golf driving range system is shown with reference to FIGS. 1 and 2 of the drawing. According to the illustrated embodiments in FIGS. 1 and 2, a new driving range according to the presently most preferred embodiments of the invention consists of a tee-box facility 1, a yard 2 having a gutter system 3 for collecting the balls, and a ball processing center 4. (For clarity of the drawing, tee-box facility 1 and ball processing and distribution center 4 are not shown in FIG. 1.)

As shown in FIG. 1, golfers M take up positions in tee boxes 5 to practice driving shots toward the yard 2. As illustrated in FIG. 1 of the drawing, golfers M in adjacent tee boxes 5 of tee-box facility 1 can strike balls without interference from each other.

As shown in FIG. 2, the tee-box facility 1 includes a plurality of tee boxes 5, which are preferably arranged in a slight arc along one end of the yard 2. Thus, a golfer in each tee box 5 can be oriented toward the central area of the yard 2. The tee-box facility 1 preferably has about thirty tee boxes 5 arranged side-by-side along a walkway 1*a*. According to a presently most preferred embodiment of the invention, the tee-box facility 1 has a second story, with the second story having another set of about thirty tee boxes 5 arranged side-by-side in the same slight arc along one end of yard 2. Thus, a total of about sixty tee boxes 5 can be provided in the tee-box facility 1. However, it is to be understood that the number of tee boxes 5 in the tee-box facility 1 is not critical to the practice of the invention, and that the tee-box facility 1 can have greater or fewer tee boxes 5.

The yard 2 preferably has a width of about 84 yards (75 meters) adjacent to the tee-box facility 1. This width is designed to accommodate a tee-box facility 1 having about thirty tee boxes 5 arranged side-by-side as shown in FIG. 2. If the tee-box facility has greater or fewer side-by-side tee boxes 5, the overall width of the yard 2 is adjusted accordingly. The yard 2 preferably has a length of about 200 yards (180 meters), which is about the distance of a long driving shot. The width of the yard 2 at the far end from the tee-box facility 1 can taper to be less than the width of the tee-box facility, for example, about 50 yards (45 meters) is sufficient.

The yard 2 is provided with downwardly sloping surfaces in the directions of the arrows shown in FIG. 1, the purpose of which is to cause any golf balls landing on these surfaces to naturally roll toward the nearest portion of a ball return gutter system 3. The yard 2 of golf driving range illustrated in FIG. 2 has similar sloping surfaces, however, they are not shown for clarity of the drawing. The surface areas of yard 2 are preferably covered with artificial golf course turf, which substantially simulates the natural green of a golf course so that a golf ball bounces as naturally as possible on the artificial turf.

The ball return gutter system 3 includes a plurality of U-shaped gutter sections that collects any golf balls landing in the yard 2 and feed them to the ball processing and distribution center 4. For example, as shown in FIGS. 1 and 2 of the drawing, branch gutter sections 3*a* feed side and central collection gutter sections 3*b*. The gutter sections 3*a* and 3*b* of the ball return gutter system 3 are all are downwardly sloped in the direction of the arrows shown aligned adjacent to the gutters in FIGS. 1 and 2 so that the balls roll therethrough by their natural tendency to roll downhill. The number and arrangement of the gutter sections 3*a* and 3*b* depends on the size of the yard 2.

Figure 3:
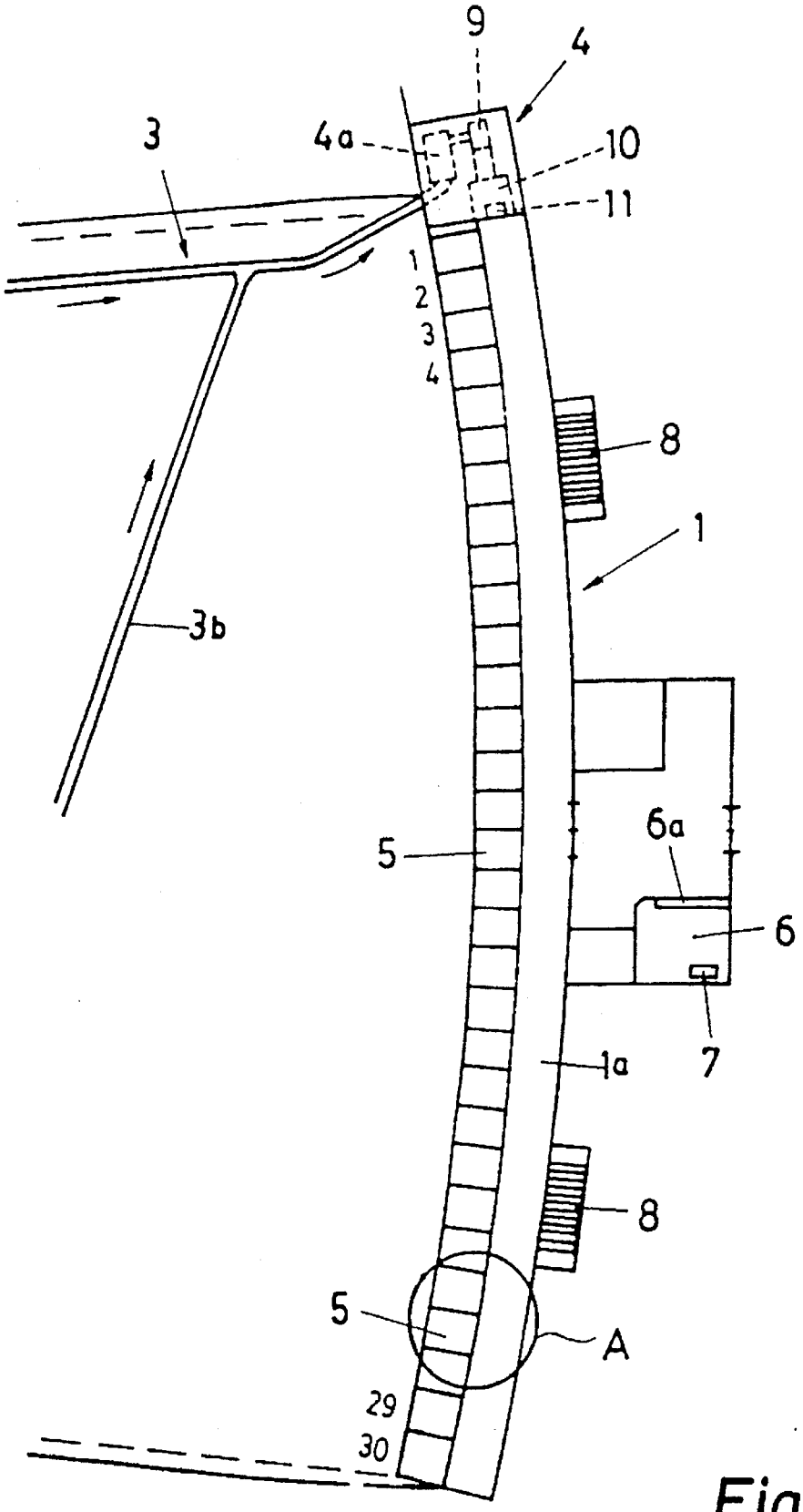
FIG. 3 is a top plan view of the tee-box facility and ball processing center of the driving range system shown in FIG. 2.

As shown in FIG. 3, the tee-box facility 1 preferably includes an information control room 6, which has a central information control device 7, a front office 6*a* at the front entrance of the driving range, and two stairways 8 to the second floor of tee boxes.

Figure 4:
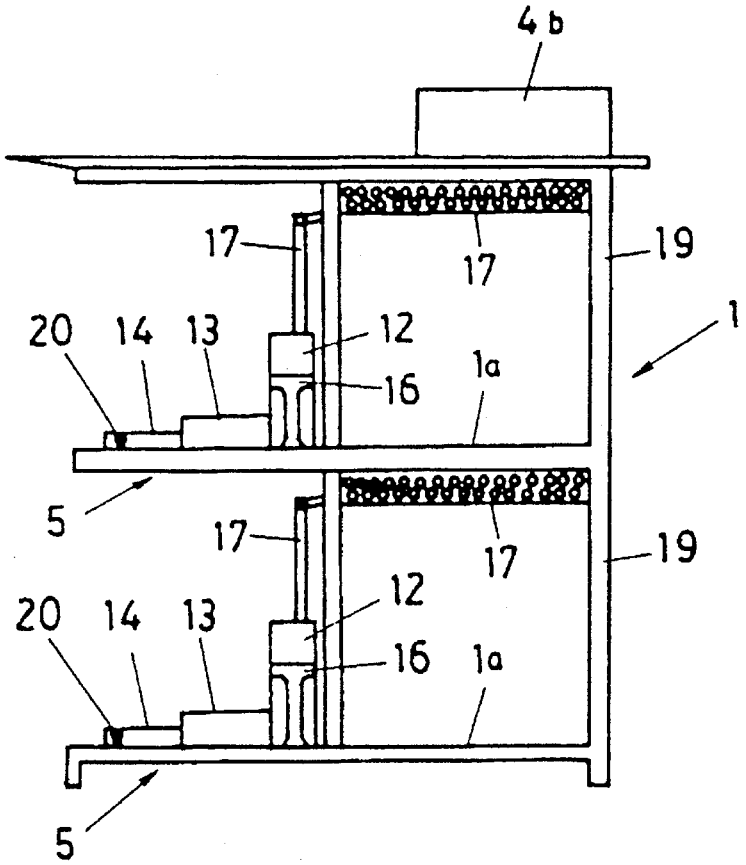
FIG. 4 is a side cross-section view showing the stacked upper and lower tee boxes of the two story tee-box facility shown in FIG. 2.
Figure 5:
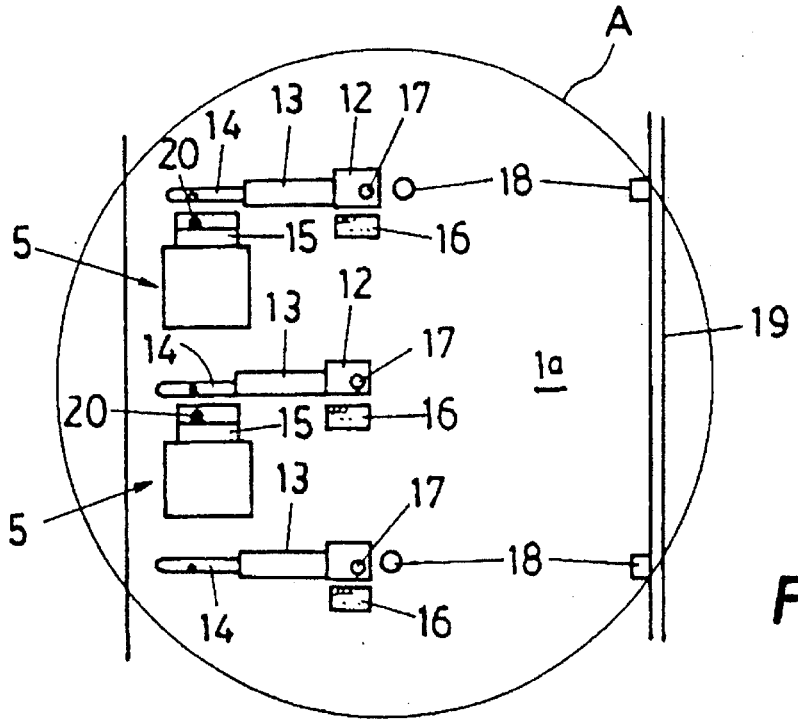
FIG. 5 is a top plan view showing two side-by-side tee boxes of a section of one of the floors of the tee-box facility shown in FIG. 2.

Referring to FIGS. 3 and 4 of the drawing, the ball processing and distribution center 4 includes a ball collection tank 4*a* which receives balls from ball return gutter system 3, a ball washing and drying machine 9, ball storage tank 10, and ball elevator 11. The ball elevator 11 carries balls from ball storage tank 10 to the ball distribution system 4*b* of the ball processing and distribution center 4. As shown in FIG. 4, the ball distribution system 4*b* is preferably in an elevated position relative to the tee boxes 5 of both the first and second stories of the tee-box facility 1. Thus, the golf balls can be distributed through the ball distribution system 4*b* by gravity to the plurality of tee boxes 5 as will hereinafter be described in detail.

Each tee box 5 preferably has a ball stock box 12, a rented ball holding box 13, an automatic tee-up machine 14, a mat 15, and a terminal device 16. As will hereinafter be described in detail, the ball distribution system 4*b* includes a plurality of ball distribution pipes 17, which are arranged to distribute balls to the ball stock 12 of each tee box 5. The tee-box facility 1 has structural support columns 18 and enclosing walls 19, which define the walkway 1*a* and the plurality of tee boxes 5 of the facility. The plurality of ball distribution pipes 17 are preferably discretely positioned above the ceiling of walkway 1*a*.

A golfer can receive a predetermined number of golf balls from the ball stock 12 into the ball holding box 13 by inserting pre-paid card, key, token, or other activating device into a predetermined slot of the terminal device 16. The structure, operation, and other desirable functions of a tee-box terminal device 16 will be hereinafter described in detail. When the golfer pushes a button on the terminal device 16, a ball 20 is discharged from the rented ball holding box 13 to the automatic tee-up machine 14 and the ball is automatically teed up on mat 15. The golfer stands on the mat 15 to swing at the ball 20. According to one embodiment of the invention, to tee up another ball, the golfer pushes a button on terminal device 16. According to an alternative embodiment, a ball 20 is automatically teed-up, and when the golfer hits the ball 20, the tee-up machine 14 automatically tees-up another ball from the rented ball box 13. This is repeated until all the balls in the rented ball holding box 13 are used up.

Referring back to FIG. 1 of the drawing, the sides and rear of the yard are preferably enclosed by protective netting 21*a* and 21*b*, respectively, to prevent a ball from flying out of the driving range. A ball that hits the netting drops onto the surface of yard 2 and rolls into the gutter system 3, to be automatically returned to the ball processing and distribution center 4.

The yard 2 has a track system 22, which preferably includes four parallel tracks 22*a*–22*d*. The tracks 22*a*–22*b* of the track system are laid lengthwise down the center of the yard 2 substantially as shown in FIGS. 1 and 2. According to a presently most preferred embodiment of the invention as hereinafter described in detail, a green target 30 and a standing target 50 are movably mounted to the tracks 22*a*–22*d* so that the distances of the green target 30 and standing target 50 from the tee boxes 5 can be adjusted as desired.

The green target 30 is intended for relatively short driving range distances. The green target 30 is mounted substantially horizontally as shown and is intended to be similar to the challenge to hitting a ball onto the green of a golf course. For example, referring to FIG. 2 of the drawing, a green target 30 can travel on tracks 22*a*–22*d* between a 90 yard marker 90Y and a 130 yard marker 130Y. Thus, the green target 30 can be selectively positioned at the marker 90Y position as shown in FIG. 2, or it can be moved to any position up to the marker 130Y position, where the green target 30 is shown in phantom lines in FIG. 2.

The standing target 50 is intended for relatively long driving range distances. The standing target 50 is mounted substantially vertically as shown so that the driving range does not have to be as long as would otherwise be required. Thus, the driving range requires less real estate, which can be a major cost factor for a driving range in a crowded urban areas. For example standing target 50 can travel on tracks 22*a*–22*b* between a 150 yard marker 150Y and a 190 yard marker 190Y. Thus, the standing target 50 can be selectively positioned at the marker 150Y position as shown FIG. 2, or it can be moved to any position up to the marker 190Y position, where the standing target 50 is shown in phantom lines in FIG. 2.

If desired, a plurality of other green targets can be placed at fixed positions on the yard 2 away from the tracks 22*a*–22*d*, for example, fixed targets 23*a* and 23*b* as shown in FIG. 2. Fixed targets 23*a* and 23*b* have similar structures as the green target 30, hereinafter described in detail, however, they are not mounted on the track system of the yard 2.

Figure 6:
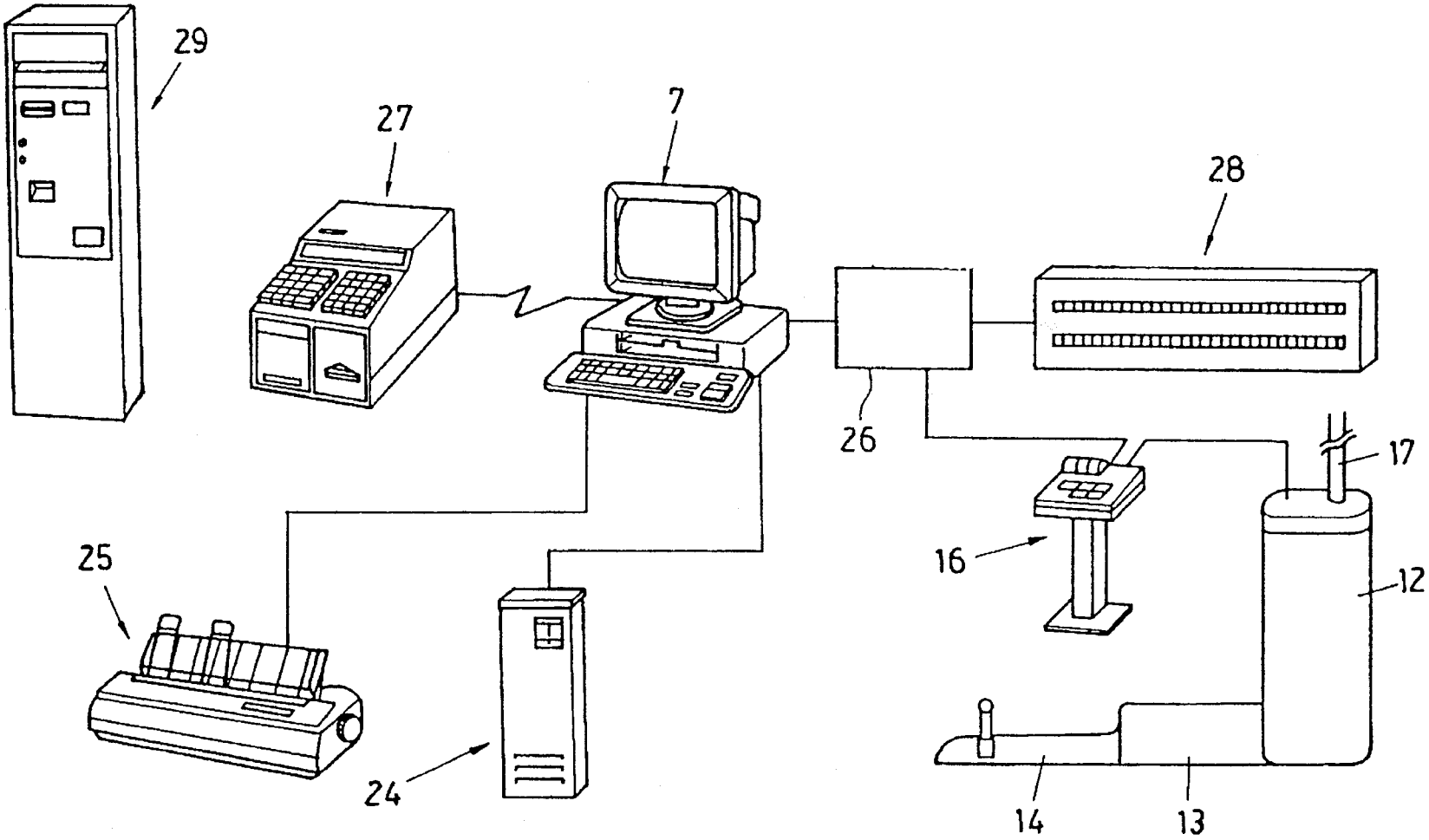
FIG. 6 is a diagram of one embodiment of the main components that are used to operate and control a driving range system shown in FIG. 2.

FIG. 6 is a diagram of one embodiment of the main components that are used to operate and control a driving range system shown in FIG. 2. Central information control device 7, such as a personal computer, is preferably located in information control room 6. A stand-by power source 24 is preferably provided in case the public utility electric power fails unexpectedly, so that the central information control device can shut down in an orderly manner without loosing operational information. A printer device 25 is operatively connected to the central information control device 7, which is for printing billing statements, receipts, use reports, scoring results and statistics, and other types of information for management of the driving range. An input-output controller 26 is operatively connected to the information control device 7, which is used to communicate with the ball distribution controller 28 and the plurality of terminal devices 16 associated with each tee box 5. A card reader 27 is provided for writing to the magnetic strip of a wallet sized card, in the nature of an automatic teller machine card or other bank debit card. Finally, a card vending machine 29 is preferably positioned in the front office 6*a* of the tee-box facility 1. Card vending machine 29 can optionally be connected to the central information control device 7.

Referring back to FIG. 1 of the drawing, as will be explained in more detail, green target 30 is preferably generally circular in shape having an overall diameter of about 10 yards (9 meters). Green target 30 has a central first place hole 31*a*, a concentric second place gutter 31*b*, and a larger concentric third place gutter 31*c*. A golfer at a tee box 5 can attempt to hit the ball onto the green target 30 as shown by FIG. 1. Depending on the flight of the ball, such as illustrated by several dashed lines A1–A3, the ball will be received by first place hole 31 a, second place gutter 31*b*, or third place gutter 31*c* of the green target 30. If the ball does not land on the green target 30, it is collected by gutter system 3 as previously described.

Figure 7A:
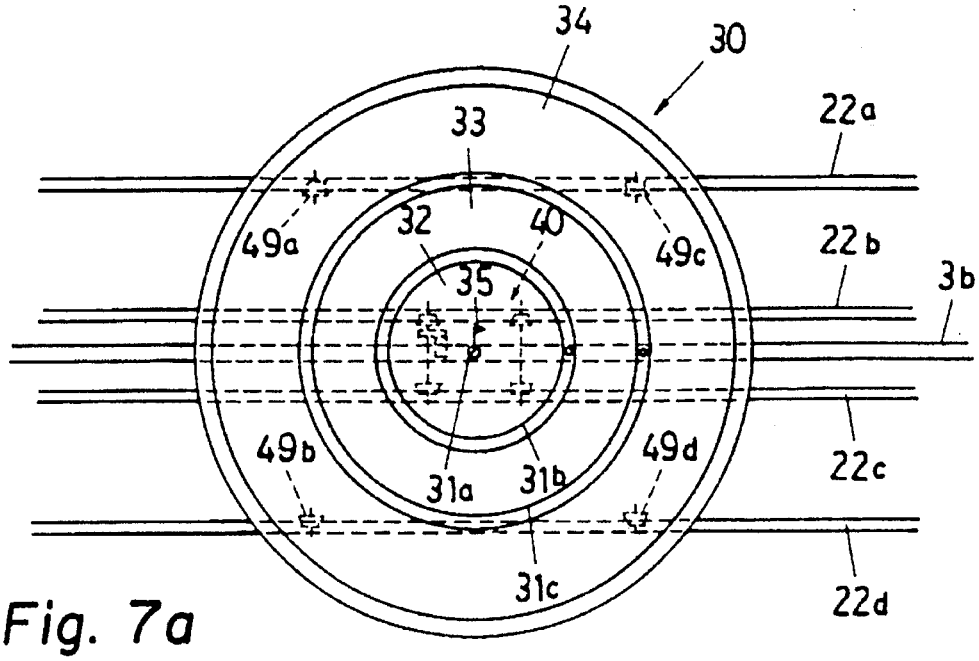
FIG. 7*a* is a top view of a movable green target on the track system of the yard shown in FIGS. 1 and 2.
Figure 7B:
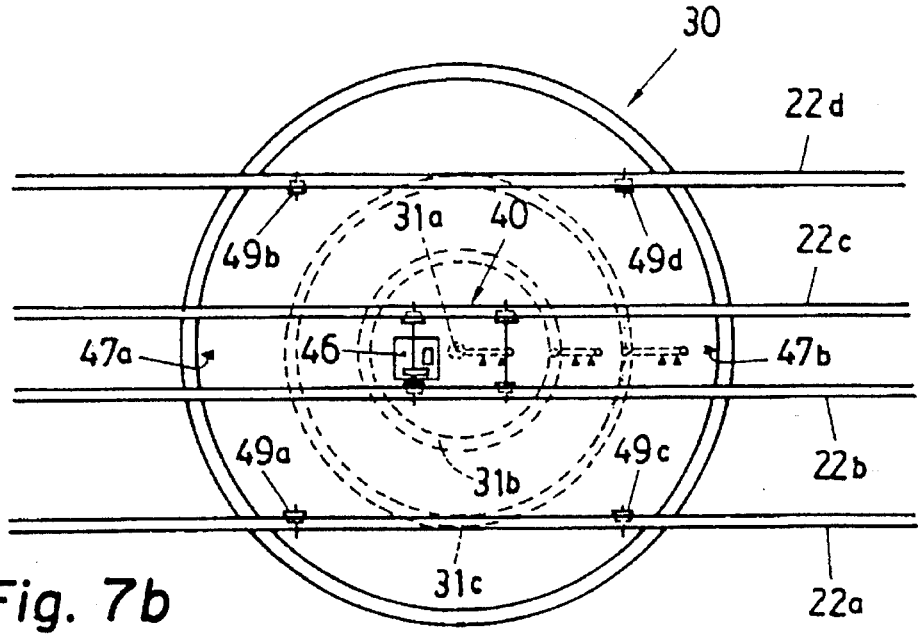
FIG. 7*b* is a bottom view, which is complementary to FIG. 7*a*, of a movable green target on the track system of the yard.

Green target 30 is described in detail with reference to FIGS. 7*a*–7e of the drawing. Green target 30 preferably has multi-tier circular green target zones. For example, three tiers are shown in FIGS. 1 and 7*a*–7*a*. The top tier 32 defines a central green area that has the central first prize hole 31*a*. The middle tier 33 concentrically surrounds the top green 32 in a generally doughnut shape and has the second prize gutter 31b. The bottom tier 34 surrounds the middle tier 33 in a generally doughnut shape and has the third prize gutter 31*c*. It is to be understood of course, that a fewer or greater number of tiers for the green target 30 are feasible. Each tier 32–34 of green target 30 is preferably covered by artificial turf, which substantially simulates the natural green of a golf course so that a golf ball bounces as naturally as possible on the artificial turf.

Figure 7C:
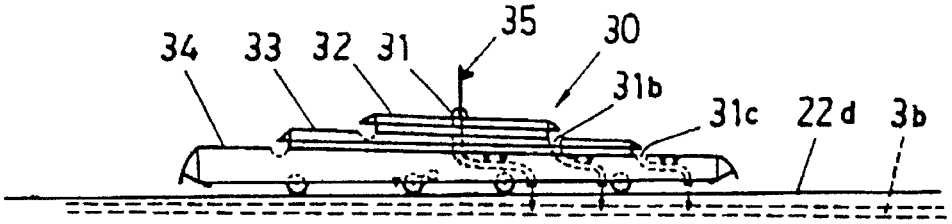
FIG. 7*c* is a side view, which is complementary to FIGS. 7*a*–7*b*, of a movable green target on the track system of the yard.
Figure 7D:
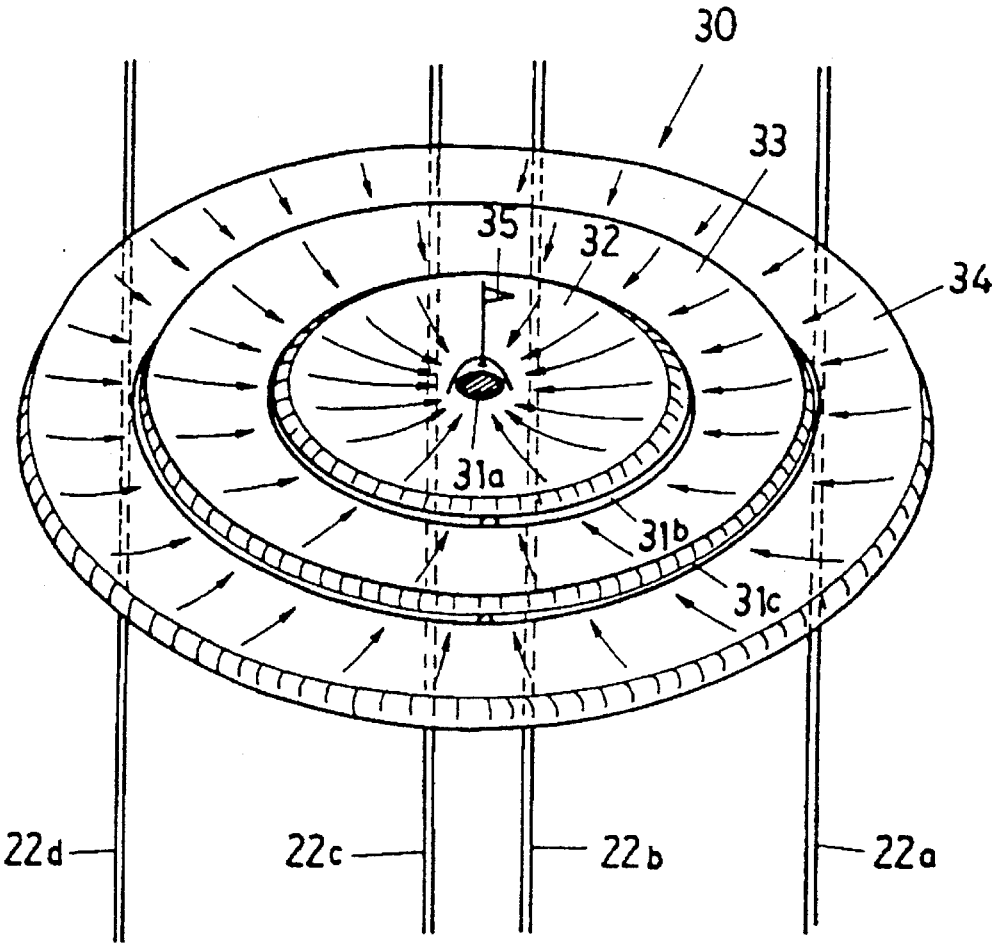
FIG. 7*d* is a perspective view taken from an elevated position in the general direction of one of the tee boxes, which is complementary to FIG. 7*a*–7*c*, of a movable green target on the track system of the yard.
Figure 7E:
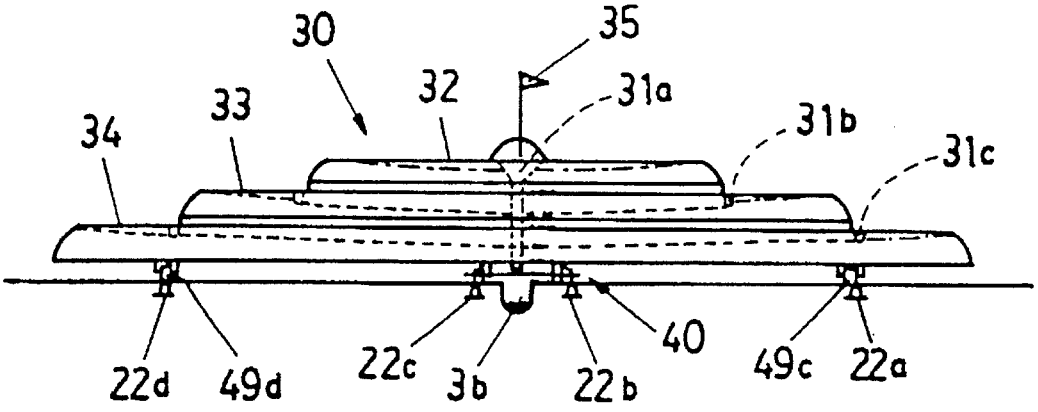
FIG. 7*e* is a front elevation view taken from the general direction of the tee boxes, which is complementary to FIG. 7*a*–7*c*, of a movable green target.

As best shown in FIG. 7*d*, the upper surface of each tier 32–34 is downwardly sloped toward the center. Thus, a ball landing on the top tier 32 rolls toward the first prize hole 31*a*, a ball landing on the middle tier 33 rolls toward the second prize gutter 31*b*, and a ball landing on the bottom tier 34 rolls toward the third prize gutter 31*c*, respectively. As best shown in FIGS. 7*c* and 7*d*, the second and third prize gutters 31*b* and 31*c*, respectively, are generally circular in the green target 30. The second and third prize gutters 31*b* and 31*c* have generally U-shaped cross-sections for collecting golf balls that roll therein. As best shown in FIG. 7*c*, the second and third prize gutters 31*b* and 31*c*, respectively, are tilted so that a ball falling into one of these gutters has a tendency to roll through the gutter toward the front end of the green target 30.

As best shown in FIG. 7*c*, the tiers 32–34 of green target 30 are also optionally tilted so that the front side toward the tee boxes 5 is slightly lower than the rear side. Thus, the tiers 32–34 of green target 30 have a small tendency to catch a ball and slow its forward movement. A ball that initially lands on the top tier 32, for example, is less likely to roll off the rear edge of top tier 32 and onto the middle tier 33. The same is true for a ball that lands toward the rear of middle tier 33—the ball is less likely to roll off the rear edge of the middle tier 33 onto the bottom tier 34. And, of course, a ball that lands on the bottom tier 34 is less likely to roll off the rear edge of the bottom tier 34 onto the yard 2 to be collected by gutter system 3. It can be desirable, however, for the tiers 32–34 not to be tilted so that the ball moves and behaves more naturally on the green target 30 and more accurately simulates a ball landing on a real golf course green.

Preferably, a target flag 35 is positioned at the center of green target 30. The target flag 35 provides a visual marker for the golfer to aim for from one of the a tee boxes 5.

Figure 8:
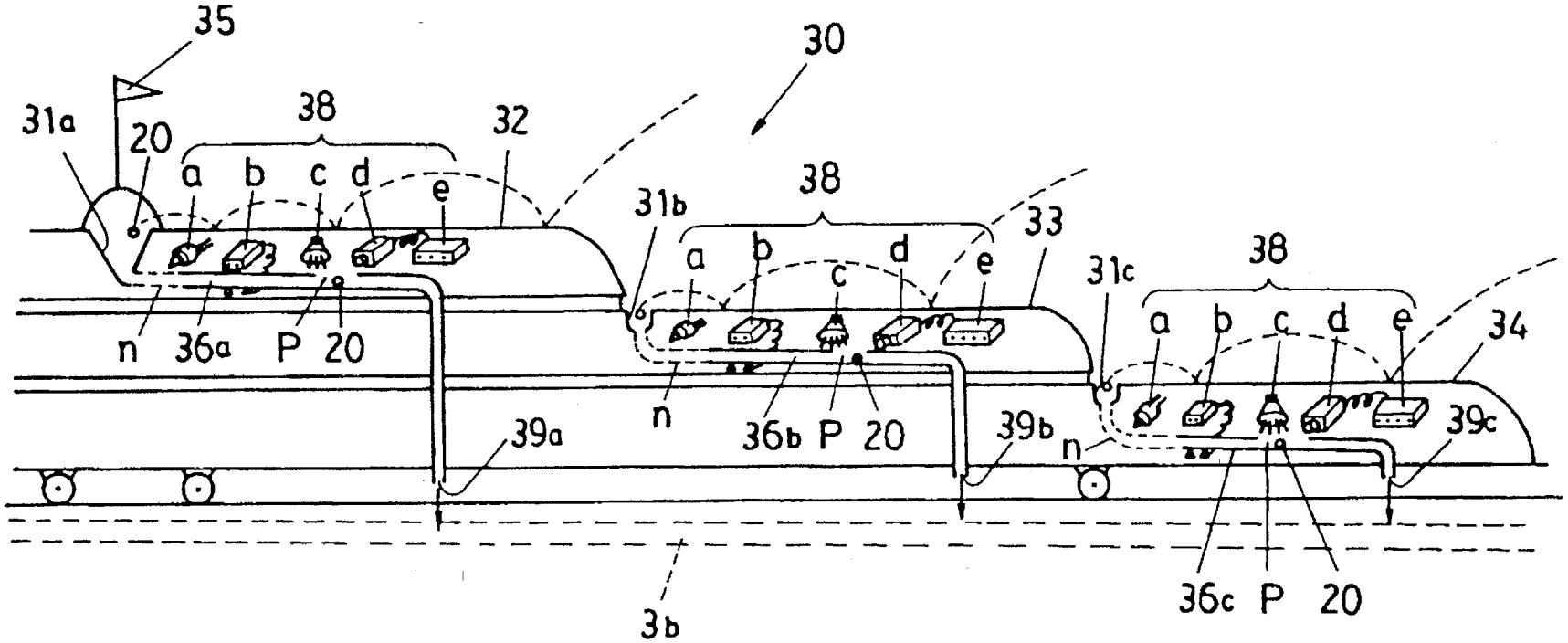
FIG. 8 is a cross-sectional view of a green target showing one embodiment of a winning ball identification system therein.

FIG. 8 of the drawing is a cross-sectional illustration of the green target 30. As previously described, a ball that lands on the top tier 32 rolls into the first prize hole 31*a* and down through first prize ball guide 36*a*. A ball that lands on the middle tier 33 rolls into the second prize gutter 31*b*, around through the gutter 31*b* toward the front end of the green target 30, and down through second prize ball guide 36*b*. Similarly, a ball that lands on the bottom tier 34 rolls into the third prize gutter 31*c*, around through the gutter 31*c* toward the front end of the green target 30, and down through third prize ball guide 36*c*.

Arranged along each ball guide 36*a*, 36*b*, and 36*c* is a separate but identical winning ball identification system 38. As a ball moves down through one of the ball guides 36*a*–36*c*, a ball identification system 38 identifies the ball as belonging to a specific tee box of the tee-box facility 1. According to one embodiment of the present invention, the ball identification system 38 has several components for identifying different characteristics, such as magnetism and color, of a winning golf ball 20 moving through one of the ball guides 36*a*– 36*c*.

For example FIG. 8 shows one embodiment of the winning ball identification systems 38 associated with each of the ball guides 36*a*–36*c*. According to this embodiment, the winning ball identification systems 38 detect magnetism and color characteristics to identify the ball as belonging to a particular tee box 5 of the tee-box facility 1. Each ball identification system 38 preferably consists of the following: a ball cleaner unit 38*a*, which cleans dust, dirt, rain water, etc. from the surface of a ball 20 by blowing compressed air toward the ball as it passes through wire net portion N of a ball guide 36*a*–36*c*; magnetism sensor 38*b*, which detects the presence or absence of magnetism of the ball 20; an illumination strobe 38*c*, which strongly illuminates a ball 20 as it passes an opening P formed in ball guide 36*a*–36*c*; a color identification sensor 38*d*, which detects the color of the ball 20 as it passes opening P; and communication unit 38*e*, which digitizes the information received from magnetism sensor 38*b* and color identification sensor 38*d* for transmittal to central information control device 7. Cleaning the ball with unit 38*a* before it reaches the color identification sensor 38*d* is desirable to obtain true color readings.

The identification information obtained with the components of the ball identification system 38 can be used to identify the ball as belonging to a particular tee box of the tee-box facility 1. For example, the presence of magnetism can be used to indicate that the ball 20 belongs to a tee box on the first floor of the tee-box facility 1, whereas the absence of magnetism can be used to indicate that the ball 20 belongs to a tee box 5 of the second floor (or vice versa). As a golf ball 20 passes an opening P of ball guide 36*a*–36*c*, the ball is lighted by an illuminating strobe from 38*c* so that the color identification sensor 38*d* can detect the color of the ball. The color of the ball identifies the particular tee box of the first or second floor to which the ball 20 belongs. According to the technology currently available on the market, a color identification sensor 38*d* can distinguish between about sixteen different colors. Thus, the combination of a magnetism sensor 38*b* and color identification sensor 38*d* can distinguish between thirty-two (32) different types of balls, the magnetism and color of which corresponds to one of thirty-two (32) different tee boxes 5, which is sufficient for a single story tee-box facility 1 of the arrangement shown in FIG. 2. However, it is anticipated that the color sensor technology will soon be improved so that a color identification sensor 38*d* can distinguish between more colors, which will enable the expansion of the system for use with a larger tee-box facility 1.

The communication unit 38*e* preferably digitizes the magnetic and color information for the ball 20 and transmits this information, together with the prize class information, to the central information control device 7. According to one embodiment of the invention, the communication unit 38*e* communicates with the central information control device via a flexible electronic cable (not shown) connected to the movable green target 30. This cable can be laid down alongside one of the tracks 22*a*–22*d*. According to an alternative embodiment of the invention, the communication unit 38*e* has a short-range radio transmitter to transmit the ball identification information and prize information to the central information control device 7.

After passing through a ball guide 36*a*, 36*b*, or 36*c* and being properly identified, the ball drops through an exit hole 39*a*, 39*b*, or 39*c*, respectively, into central ball collection gutter section 3*b* of gutter system 3, through which the ball travels back to the ball processing and distribution center 4 as previously described.

Figure 9:
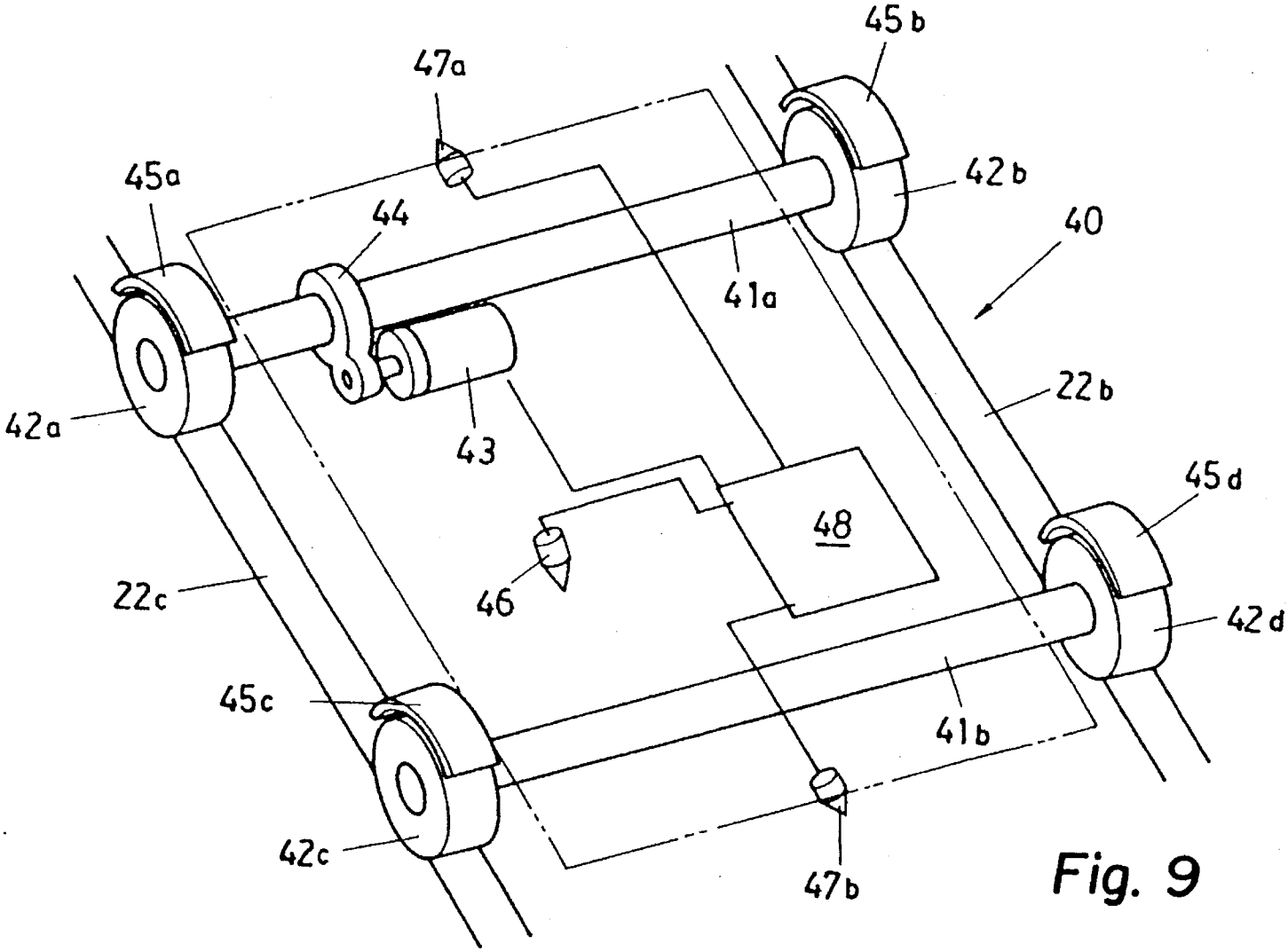
FIG. 9 is a bottom view of a suitable drive assembly attached to the bottom side of a green target for moving the target on the track system of the yard.

FIG. 9 is one example of a suitable drive assembly 40 for moving the green target 30 along tracks 22*a*–22*d*. The drive assembly 40 is constructed as shown in FIG. 9 and attached to the bottom side of green target 30. Drive assembly 40 has two parallel wheel axles 41*a* and 41*b*, four wheels 42*a*–42*d* attached to the end of the two axles 41*a* and 41*b*, an electric motor 43, a speed reducing gear 44 operatively connected between the motor 43 and wheel axle 41*a*, four brakes 45*a*–45*d* to stop the rotation of the wheels 42*a*– 42*d*, position sensors, such as sensors 46, 47*a*, and 47*b*, and computer controller 46. The drive assembly 40 travels with the four wheels 42*a*– 42*d* on the two central tracks 22*b* and 22*c*. If desired to provide increased stability to the green target 30, the axles 41*a* and 41*b* can be extended so that four additional wheels (not shown) can be mounted to the outer side of green target 30 which travel on the two outside tracks 22*a* and 22*d*. Alternatively, simple caster wheel assemblies (not shown) can be employed to support the outer portions of the green target 30 on outside tracks 22*a* and 22*d*.

The drive assembly 40 is preferably electric powered. The electric power lead is flexibly attached to green target 30 so that it can be turned on by a remote control device, preferably the central information control device 7. The revolution speed of motor 43 is appropriately reduced by reducing gear 44 to convey motive power through axles 41a to wheels 42*a* and 42*b*, which causes the green target 30 to travel slowly on the tracks 22*b* and 22*c*. The direction of operation of the motor 43 can be reversed so that the green target 30 can be moved in either direction along the tracks 22*a*–22*d*.

There are a number of different ways for controlling how far the drive assembly 40 moves the green target 30 along the track system of tracks 22*a*– 22*d*. For example, according to a presently preferred embodiment of the invention, a pattern of lights, such as a plurality of spaced apart light sources, is positioned along the tracks 22*a*–22*d* such that the sensor 46 can detect the lights of the pattern. When the computer controller receives a command from the central information control device, which includes direction and distance information for moving the green target 30, the controller 48 selectively connects electric power to the motor 43 to move the green target 30 in the desired direction along the track system. As the drive assembly 40 moves the green target 30 along the track system, each time the sensor 46 passes over one of the light sources of the pattern along the tracks, it sends an electronic signal to the computer controller 48. Once the computer controller 48 has received a preselected number of signals from the sensor 46, which corresponds to a preselected distance, the controller48 selectively disconnects electric power from the motor 43 and applies the brakes 45*a*–45*d*, thereby stopping the movement of the green target 30.

In case a light sensor 46 fails to work and the drive assembly 40 continues to move the green target 30 toward either of two pre-set end points on the tracks 22*a*–22*d*, a backup stopping system is preferably provided. For example, stop light sources are positioned to mark the two pre-set end points along the tracks 22*a*–22*d* for the movement of the green target 30. If light sensor 47*a* detects a stop light source, it sends an electronic signal to the computer controller 48, which selectively disconnects electric power from the motor 43 and applies the brakes 45*a*–45*d*, thereby stopping the movement of the green target 30 in that direction. If light sensor 47*b* detects a stop light source at the other pre-set end point along the track system, it sends an electronic signal to the computer controller 48, which selectively disconnects electric power from the motor 43 and applies the brakes 45*a*–45*d*, thereby stopping the movement of the green target 30 in the opposite direction.

Winning ball identification systems 38 and drive assembly 40 use standard public utility voltage electricity, which is connected to the moving green target 30 by a flexible power lead (not shown). According to this embodiment of the invention, the power lead can be wound onto a self-winding spool that plays out additional power lead to the target 30 when it moves in one direction along the tracks 22*a*–22*d* and retracts and rewinds the power lead when it moves in the opposite direction along the tracks 22*a*–22*d*. According to an alternative embodiment of the invention, power lines are laid down along one of the tracks 22*a*–22*d*, and the green target 30 has a contacting lead that can slide along the exposed power lead wires to provide electric power to the target 30, much like an electric train.

Referring back to FIG. 1 of the drawing, as will be explained in more detail, standing target 50 is preferably generally circular in shape having an overall diameter of about 10 yards (9 meters). Standing target 50 has a central first place opening 51*a*, a concentric second place opening 51*b*, and a larger concentric third place opening 51*c*. Golfers M at tee boxes 5 can attempt to hit the ball to the standing target 50 as shown by FIG. 1. Depending on the flight of the ball, such as illustrated by several dashed lines B1–B3, the ball will be received by first place opening 51*a*, second place opening 51*b*, or third place opening 51*c* of the standing target 50. If the ball does not enter one of the openings 51*a*–51*c* of the standing target 50, it is collected by gutter system 3 as previously described.

Standing target 50 is described in detail with reference to FIGS. 10*a*– 10*c* of the drawing. Standing target 50 preferably has multiple concentric target openings. For example, the three openings 51*a*–51*c* shown in FIGS. 1 and 10*a*–10*c*. The first place opening 51*a* is positioned at the center of the vertical standing target 50. The second place opening 51*b* concentrically surrounds the central first place opening 51*a* in a generally doughnut shape. And the third prize opening 51*c* concentrically surrounds the second place opening 51*b* in a generally doughnut shape. It is to be understood, of course, that a fewer or greater number of openings for the standing target 50 are feasible.

Figure 10A:
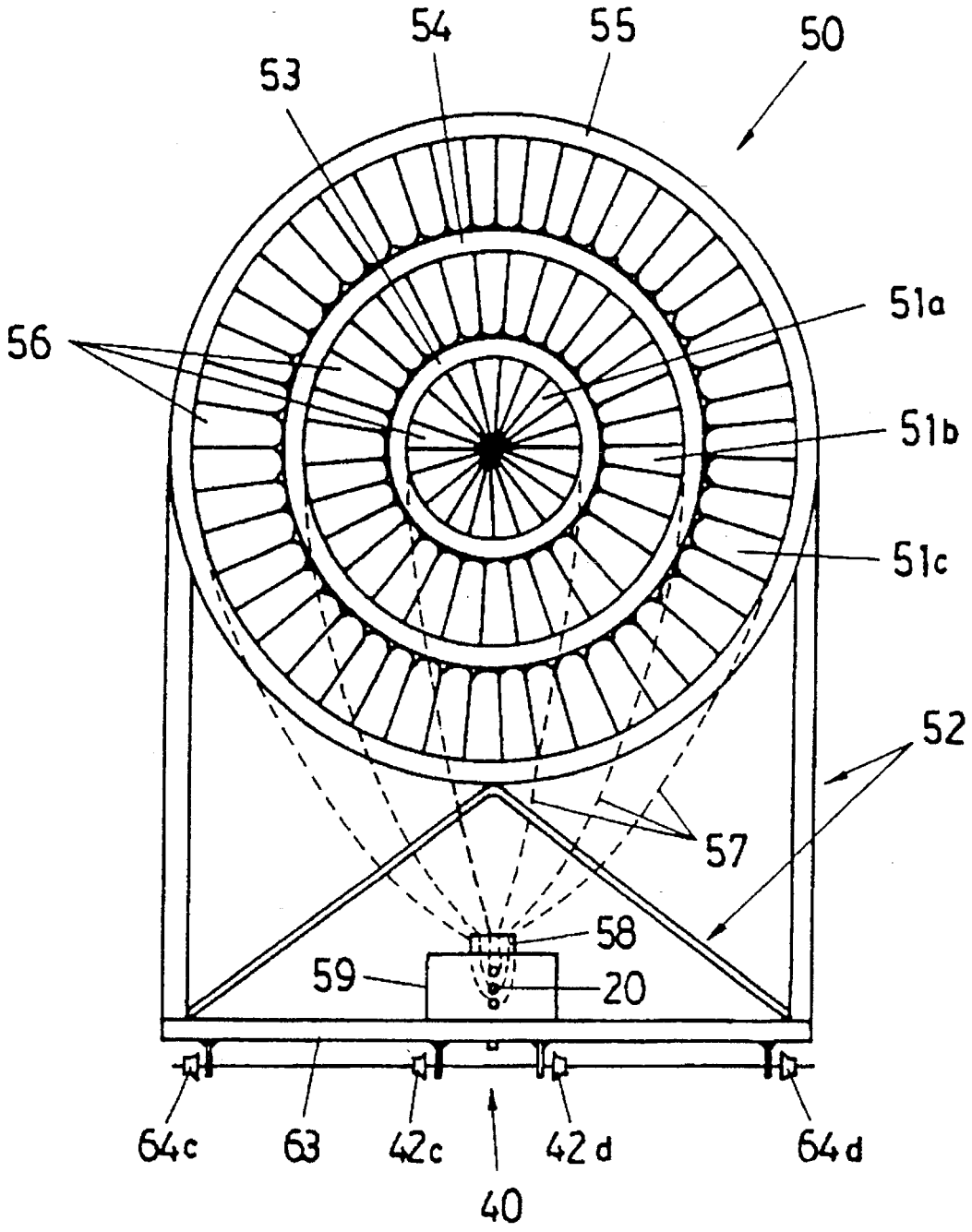
FIG. 10*a* is a front view of standing target for mounting to the track system of a yard.
Figure 10B:
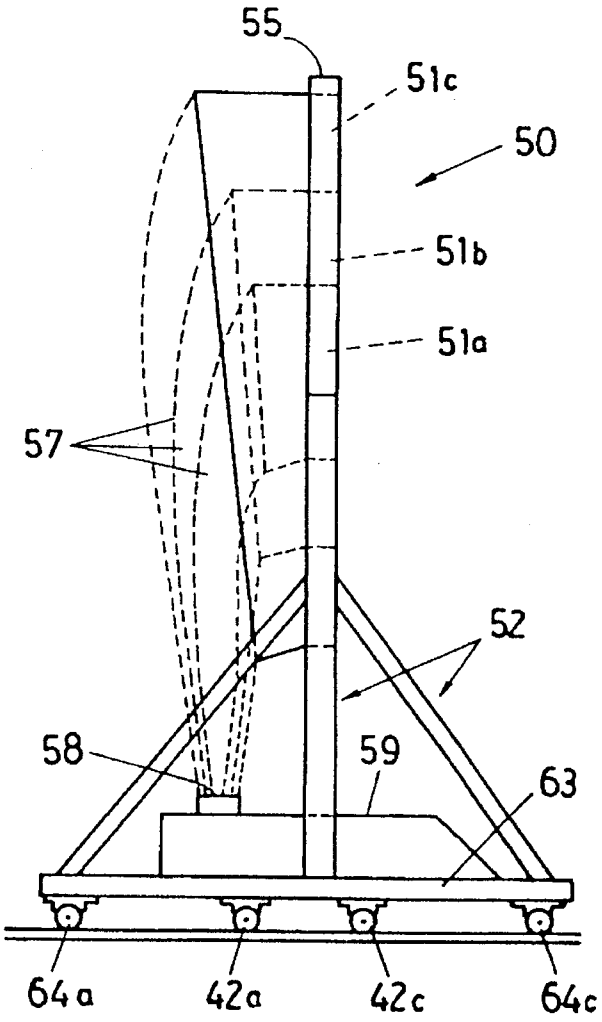
FIG. 10*b* is a side elevation view, which is complimentary of FIG. 10*a*, of a standing target.
Figure 10C:
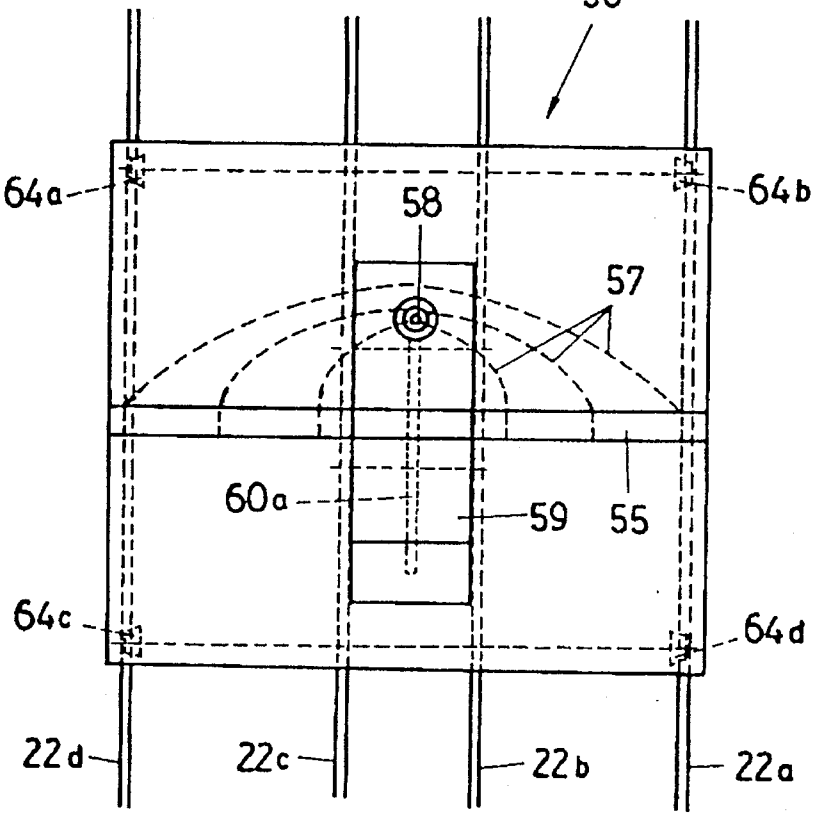
FIG. 10*c* is a top plan view, which is complimentary of FIGS. 10*a* and 10*b*, of the standing target showing the standing target mounted on the track system of the yard.

As shown in FIGS. 10*a*–10*c*, standing target 50 has a vertical support structure defined by support struts 52. The central first place opening 51*a* is bounded by first circular frame 53. The concentric second place opening 51*b* is bounded by second circular frame 54. And the concentric third place opening 51*c* is bounded by third circular frame 55.

The circular frames 53–55 each support a generally cone-shaped piece of netting material 56. The netting material can be formed of a webbed material, such as cloth or plastic netting, or it can be formed of a sheet material, such as plastic or rubber material. The netting material 56 can be flexible or rigid, so long as it captures a golf ball and guides it toward and through the drop guide portion 57 thereof. The netting material 56 guides the balls down to receiving hole 58 in a protective case 59, which encloses a winning ball identification system for standing target 50.

Figure 11:
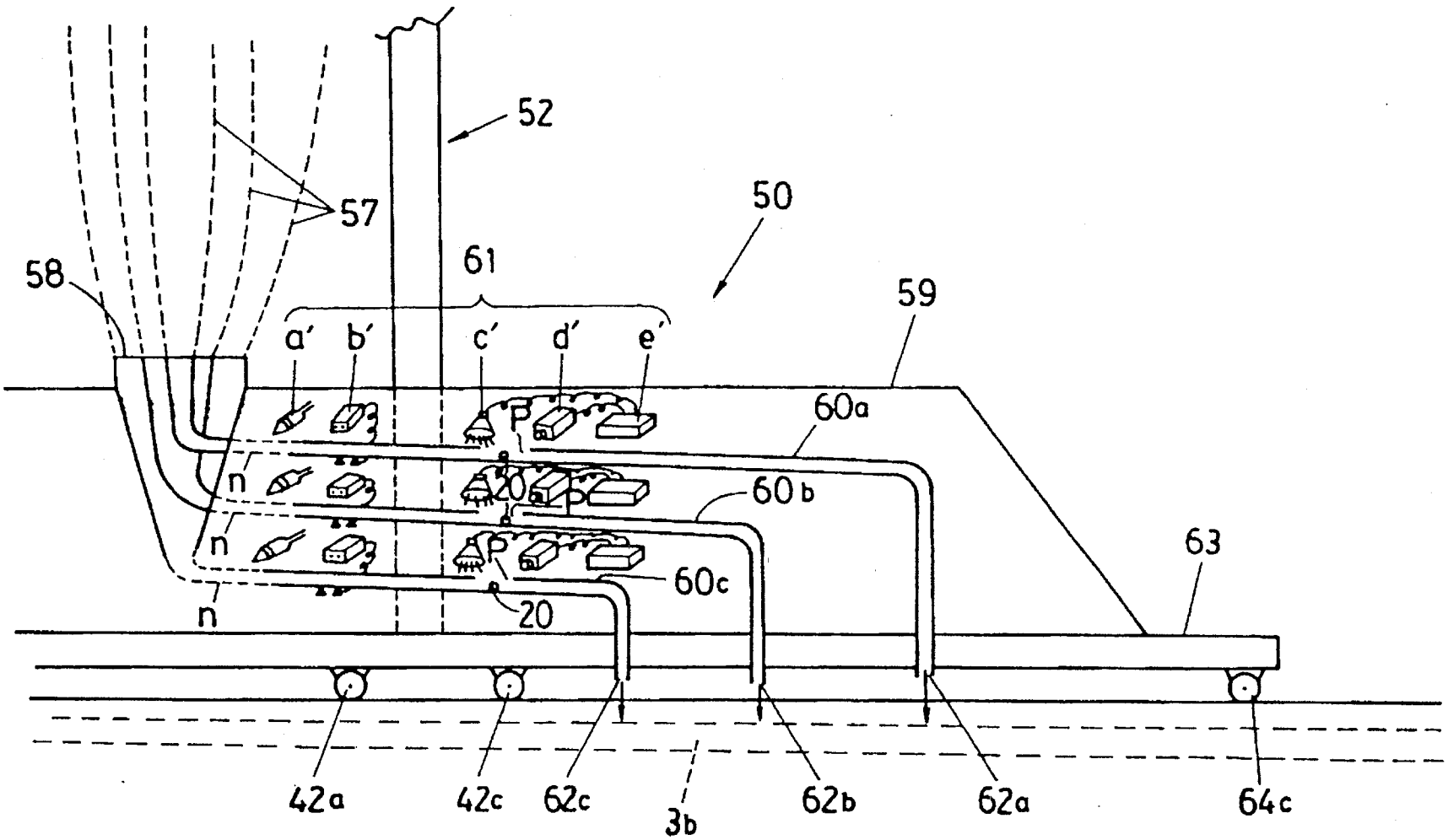
FIG. 11 is a cross-sectional illustration of a standing target showing one embodiment of a winning ball identification system therein.

FIG. 11 of the drawing is a cross-sectional illustration of the standing target 50. As best shown in FIG. 11, a ball that flies into the first opening 51*a* is captured by the netting material 56 mounted to circular frame 53, guided through the drop guide portion 57 thereof down to winning ball receiving hole 58 in a protective case 59 and into first prize ball guide 60*a*. Similarly, a ball that flies into the second opening 51*b* is captured by the netting material 56 mounted to circular frame 54, guided through the drop guide portion 57 thereof down to winning ball receiving hole 58 and into second prize ball guide 60*b*. And a ball that flies into the third opening 51*c* is captured by the netting material 56 mounted to circular frame 55, guided through the drop guide portion 57 thereof down to winning ball receiving hole 58 and into third prize ball guide 60*c*.

Arranged along each ball guide 60*a*, 60*b*, and 60*c* is a winning ball identification system 61. As a ball moves down through one of the ball guides 60*a*–60*c*, one of the ball identification systems 61 identifies the ball as belonging to a specific tee box of the tee-box facility 1. According to one embodiment of the present invention, a ball identification system 61 has several components for identifying different characteristics of a winning golf ball 20 moving through one of the ball guides 60*a*–60*c*.

For example, FIG. 11 shows one embodiment of the winning ball identification systems 61 associated with each of the ball guides 60*a*–60*c* of standing target 50. According to this embodiment, the winning ball identification systems 61 detect magnetism and color characteristics to identify the ball as belonging to a particular tee box 5 of the tee-box facility 1. Each winning ball identification system 61 preferably consists of the following: a ball cleaner unit 61*a*, which cleans dust, dirt, rain water, etc. from the surface of a ball 20 by blowing compressed air toward the ball as it passes through wire net portion N of a ball guide 60*a*–60*c*; magnetism sensor 61*b*, which detects the presence or absence of magnetism of the ball 20; an illumination strobe 61*c*, which strongly illuminates a ball 20 as it passes an opening P formed in ball guide 60*a*–60*c*; a color identification sensor 61*d*, which detects the color of the ball 20 as passes opening P; and communication unit 61*e*, which digitizes the information received from magnetism sensor 61*b* and color identification sensor 61*d* for transmittal to central information control device 7. Cleaning the ball with unit 61*a* before it reaches the color identification sensor 61*d* is desirable to obtain true color readings.

The identification information obtained with the components of the ball identification system 61 can be used to identify the ball as belonging to a particular tee box as follows. For example, the presence of magnetism can be used to indicate that the ball 20 belongs to a tee box on the first floor of the tee-box facility 1, whereas the absence of magnetism can be used to indicate that the ball 20 belongs to a tee box 5 of the second floor (or vice versa). As a golf ball 20 passes an opening P of ball guide 60*a*–60*c*, the ball is lighted by an illuminating strobe from 61 c so that the color identification sensor 61*d* can detect the color of the ball. The color of the ball identifies the particular tee box of the first or second floor to which the ball 20 belongs. According to the technology currently available on the market, a color identification sensor 61*d* can distinguish between about sixteen different colors. Thus, the combination of a magnetism sensor 61*b* and color identification sensor 61*d* can distinguish between thirty-two (32) different types of balls, the magnetism and color of which corresponds to one of thirty-two (32) different tee boxes 5, which is sufficient for a single story tee-box facility 1 of the arrangement shown in FIG. 2. However, it is anticipated that the color sensor technology will soon be improved so that a color identification sensor 61*d* can distinguish between more colors, which will enable the expansion of the system for use with a larger tee-box facility 1.

The communication unit 61*e* preferably digitizes the magnetic and color information for the ball 20 and transmits this information, together with the prize class information, to the central information control device 7. According to one embodiment of the invention, the communication unit 61*e* communicates with the central information control device via a flexible electronic cable (not shown) connected to the movable standing target 50. This cable can be laid down along beside one of the tracks 22*a*–22*d*. According to an alternative embodiment of the invention, the communication unit 61*e* has a short-range radio transmitter to transmit the ball identification information and prize information to the central information control device 7.

After passing through a ball guide 60*a*, 60*b*, or 60*c* and being properly identified by ball identification system 61, the ball drops through ball an exit hole 62*a*, 62*b*, or 62*c*, respectively, into central ball collection gutter section 3*b* of gutter system 3, through which the ball travels back to the ball processing and distribution center 4 as previously described.

As shown in FIGS. 10*a*–10*c*, the standing target 50 has a drive assembly 40 that is preferably the same as the previously described drive assembly 40 for the green target 30 shown in FIG. 9. The drive assembly 40 for moving the standing target 50 along tracks 22*a*–22*d* attached to the base frame plate member 63 of standing target 50, to which the structural members 52 are mounted on the top side thereof. As previously described with reference to FIG. 9, drive assembly 40 has two parallel wheel axles 41*a* and 41*b*, four wheels 42*a*–42*d* attached to the end of the two axles 41*a* and 41*b*, an electric motor 43, a speed reducing gear 44 operatively connected between the motor 43 and wheel axle 41*a*, four brakes 45*a*–45*d* to stop the rotation of the wheels 42*a*–42*d*, position sensors, such as sensors 46, 47*a*, and 47*b*, and computer controller 48. The drive assembly 40 travels with the four wheels 42*a*–42*d* on the two central tracks 22*b* and 22*c*. As shown in FIGS. 10*a*–10*c*, the base frame plate member 63 of standing target 50 also has additional wheels 64*a*, 64*b*, 64*c*, and 64*d* to provide increased stability to the standing target 50.

The drive assembly 40 is preferably electric powered. The electric power lead is flexibly attached to standing target 50 so that it can be turned on by a remote control device, which is preferably the central information control device 7. The revolution speed of motor 43 is appropriately reduced by reducing gear 44 to convey motive power through axles 41*a* to wheels 42*a* and 42*b*, which causes the green target 30 to travel slowly on the tracks 22*b* and 22*c*. The direction of operation of the motor 43 can be reversed so that the standing target 50 can be moved in either direction along the tracks 22*a*–22*d*. The drive assembly 40 for the standing target 50 is preferably controlled as previously described for the green target 30.

Winning ball identification systems 61 and drive assembly 40 use standard public utility voltage electricity, which is connected to the standing target 50 by a flexible power lead (not shown). According to this embodiment of the invention, the power lead can be wound onto a self-winding spool that plays out additional power lead to the standing target 50 when it moves in one direction along the tracks 22*a*–22*d* and retracts and rewinds the power lead when it moves in the opposite direction along the tracks 22*a*–22*d*. According to an alternative embodiment of the invention, power lines are laid down along one of the tracks 22*a*–22*d*, and the standing target 50 has a contacting lead that can slide along the exposed power lead wires to provide electric power to the standing target 50, much like an electric train.

Referring briefly back to FIG. 3 of the drawing, as previously described, the gutter system 3 moves golfs balls to the collection tank 4*a* of ball processing and distribution center 4. Batches of balls from the collection tank 4*a* are moved through the washing and drying machine 9, then to ball storage 10, from where they are lifted to the ball distribution system 4*b*.

Figures 12, 12A:
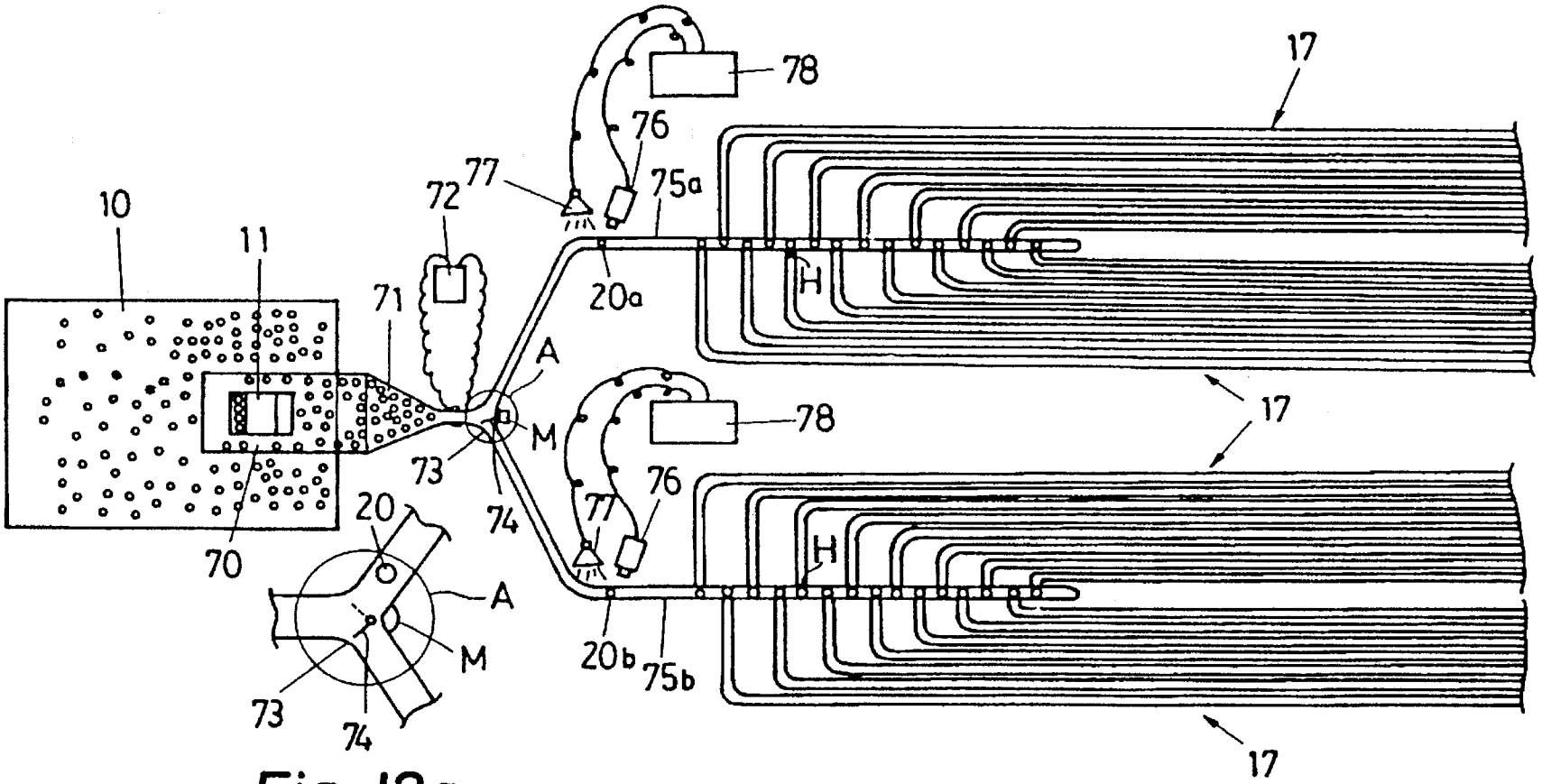
FIG. 12 is a plan view of a ball distribution system that distributes the golf balls to the individual tee boxes of the tee-box facility after they have been collected by the gutter system of the yard.
FIG. 12*a* is a detail of the selection mechanism shown in FIG. 12 for directing a particular golf ball through a forked passage so that the ball can be selectively moved through conduits to the tee boxes of the first or second floor.
Figures 13, 13A:
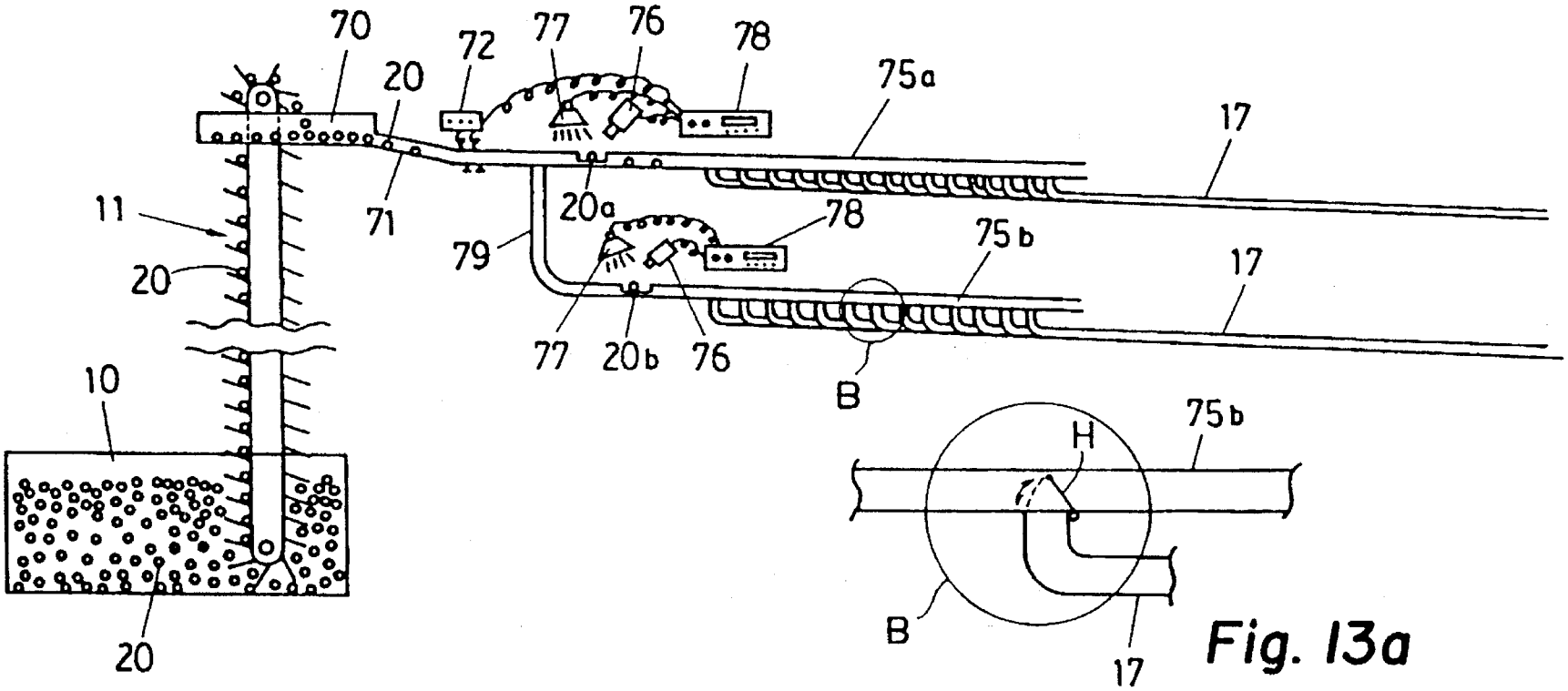
FIG. 13 is a side view of the ball distribution system shown in FIG. 12.
FIG. 13*a* is a detail of the structure showing how a golf ball is selectively moved from a distribution conduit to a particular pipe for delivering the ball to a particular tee box of the tee-box facility.

The structure and operation of the ball distribution system 4*b* of the processing and distribution center 4 is described with reference to FIGS. 12, 12*a*, 13, and 13*a*. FIG. 12 is a plan view of a ball distribution system 4*b* that distributes the golf balls to the individual tee boxes 5 of the tee-box facility 1 after they have been collected by the gutter system of the yard. FIG. 13 is a side view of the ball distribution system 4*b* shown in FIG. 12.

Referring now to FIGS. 12 and 13 of the drawing, golf balls are carried upward from ball storage 10 by ball elevator 11 to ball holder 70 of ball distribution system 4*b*, which as shown in FIG. 4 is located in the tee-box facility 1 above the ceiling of walkway 1*a* of the second floor tee boxes 5. The bottom of the ball holder 70 is sloped so that the balls move downwardly toward triangular ball guide passage 71. The lower exit passage of ball guide passage 71 is only wide enough for one ball to pass through at a time. Magnetism sensor 72 is attached to exit end of passage 71 for detecting the magnetism of a passing ball 20.

As best shown in FIGS. 12 and 12*a*, the exit end of passage 71 has a forked path 73. In response to a signal from the magnetism sensor 72, a servo motor M switches the position of ball separation paddle 74 between a first position and a second position shown in phantom lines. At fork 73 all balls are diverted between an upper distribution conduit 75*a* and a lower distribution conduit 75*b*. Magnetism sensor 72 causes switching motion of ball separation paddle 74 so that a magnetized ball 20a is sent to the upper distribution conduit 75*a* and non-magnetized ball 20*b* to the lower distribution conduit 75*b* (or vice versa). Upper and lower distribution conduits 75*a* and 75*b*, respectively, are preferably slightly sloped so that a ball rolls therethrough.

As best shown in FIGS. 13 and 13*a*, a magnetized ball 20*a* rolls through upper distribution conduit 75*a*, which runs above the ceiling of the walkway 1*a* on the second floor of tee-box facility 1. As the ball 20*a* moves through upper distribution conduit 75*a*, it passes an opening formed in the upper side of the conduit 75*a* so that an illumination strobe 77 can strongly illuminate the ball 20*a* and a color identification sensor 76 can detect the color of the ball 20*a*. Communication unit 78 digitizes the information received from magnetism sensor 72 and the color identification sensor 76 and transmits this information to central information control device 7. According to this identification information, central information control device 7 instructs a particular drop hole H to open in the passage 75*a* so that the ball 20*a* drops into a ball distribution pipe 17 to reach to ball stock 12 of the particular second floor tee box to which the ball 20*a* belongs.

On the other hand, a non-magnetized colored ball 20*b* operated at fork 73 by separation paddle 74 falls through passage 79 and into lower distribution conduit 75*b*, which runs above the ceiling of walkway 1*a* on the first floor of the tee-box facility 1. As the non-magnetized ball 20*b* rolls through the lower distribution conduit 75*b*, it passes an opening formed in the upper side of the conduit 75*b* so that an illumination strobe 77 can strongly illuminate the ball 20*b* and a color identification sensor 76 can detect the color of the ball 20*b*. Communication unit 78 digitizes the information received from magnetism sensor 72 and the color identification sensor 76 and transmits this information to central information control device 7. According to this identification information, central information control device 7 instructs a particular drop hole cover H to open in the lower distribution conduit 75*b* so that the ball 20*b* drops into a ball distribution pipe 17 to reach to ball stock 12 of the particular first floor tee box to which the ball 20*b* belongs.

Figure 14:
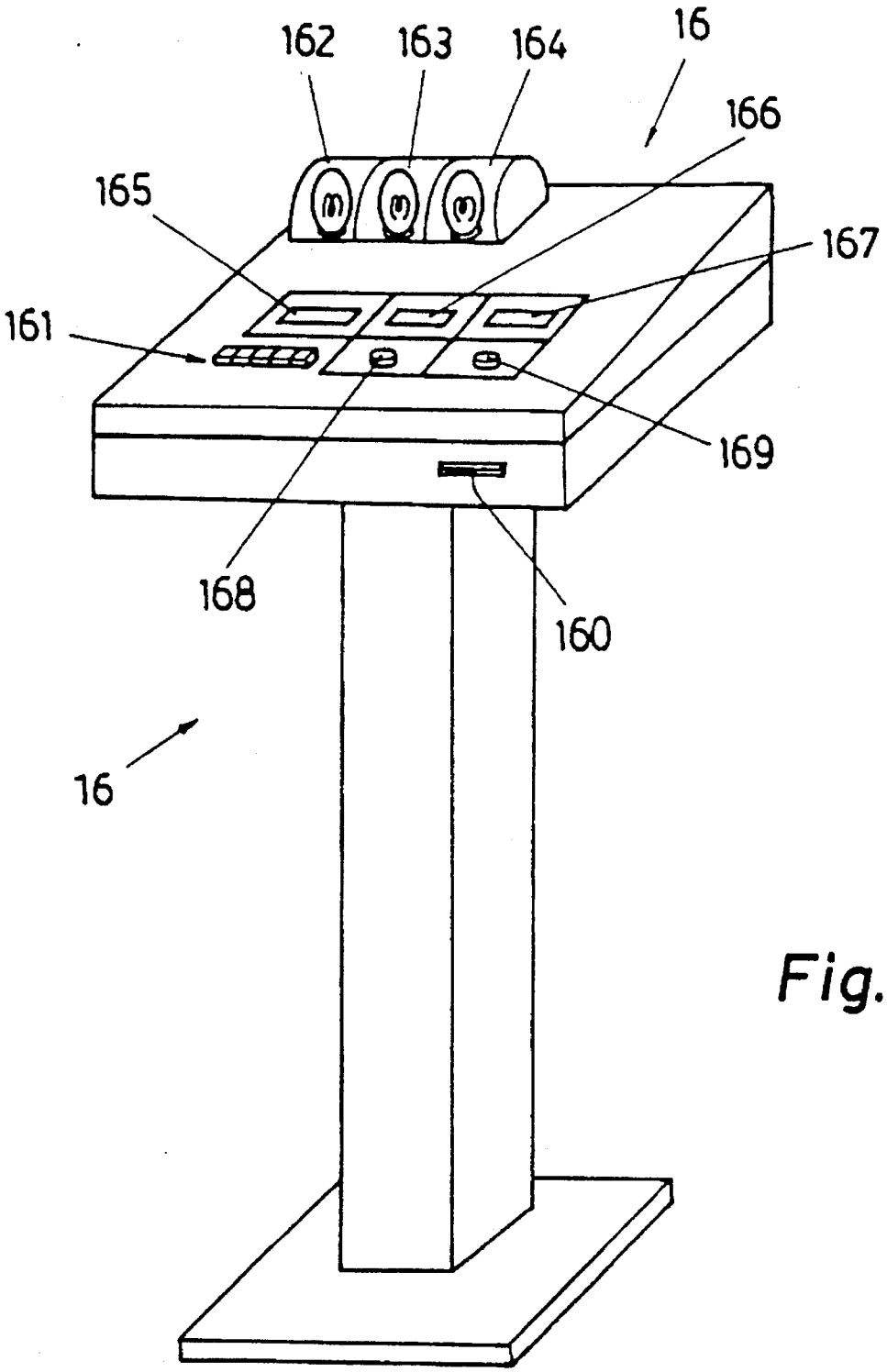
FIG. 14 is a perspective view of one example of a terminal device installed at each tee box.

FIG. 14 is a perspective view of one example of a terminal device 16 installed at each tee box 5. The terminal 16 has a pre-paid card insertion slot 160, rent ball selection buttons 161, a first prize red lamp 162, a second prize blue lamp 163, a third prize white lamp 164, a prize class LCD display 165, pre-paid card balance and prize ball LCD panel 166, prize point LCD display panel 167, prize ball claim button 168, and prize point registration button 169.

To use the driving range system, a golfer enters the front office 6*a* of the tee-box facility 1 and purchases a pre-paid card from the pre-paid card vending machine 29. A clerk can check the information control device 7 to determine which tee boxes are vacant and available for use, and assign the golfer an available tee box. Alternatively, a display board can indicate which tee boxes of the facility 1 are available for use, and the golfer can simply go to a vacant tee box 5.

By inserting the pre-paid card into pre-paid card insertion slot 160 of terminal device 16, a golfer is informed of the available balance on his card at LCD display 166. To purchase a certain number of balls, the golfer pushes one of ball selection buttons 161, which releases the selected number of balls from ball stock box 12 to rented holding box 13. Automatic tee-up machine 14 tees up one of the balls in the rented ball holding box 13.

As shown in FIG. 1, the golfer attempts to hit either the green target 30 or the standing target 50. Or as shown in FIG. 2, the golfer may also attempt to hit the fixed green targets 23*a* or 23*b*.

For example, if the golfer strikes a golf ball such that it flies as described by parabola dashed line A1, the ball should land on top tier 32 and roll into the first prize hole 31*a*. From the first prize hole 31*a*, the ball drops into ball guide 36*a*. As it passes a wire net portion N of the ball guide, the ball cleaner unit 38*a* blasts the ball with compressed air to clean the ball of water and dirt. As the ball rolls through the ball guide 36*a*, it first passes magnetism sensor 38*b*, and then it passes opening P, where illuminating strobe 38*c* lights the ball so that color identification sensor 38*d* can detect the color of the ball. Communication unit 38*e* transmits the magnetic and color information to the central information control device 7, which matches this ball identification information with the particular tee box 5 from which it came. The central information control device 7 relays the first prize information to the terminal device 16 of the particular tee box 5, which flashes first prize lamp 162 of the terminal device 16 and displays the prize information on LCD display 167. The amount or value of this first prize depends on the distance of the green target 30 from the tee boxes. If the golfer strikes a golf ball such that it flies as described by parabola dashed line A2 or A3, the ball is similarly identified as a second or third prize winning ball. After being identified as a winning ball, the ball passes through one of the exit holes 39*a*–39*c* into gutter section 3*b* of gutter system 3, which carries the ball to the ball processing and distribution center 4.

Referring again to FIG. 1, if the golfer strikes a golf ball such that it flies as described by parabola dashed line B1, the ball should enter the central first prize opening 51*a*. As best shown in FIG. 10*a*, the ball is captured by the netting material 56 mounted to circular frame 53, guided through the drop guide portion 57 thereof down to winning ball receiving hole 58 in a protective case 59 and into first prize ball guide 60*a*. As best shown in FIG. 11, as the ball passes a wire net portion N of the ball guide 60*a*, the ball cleaner unit 61*a'* blasts the ball with compressed air to clean the ball of water and dirt. As the ball rolls through the ball guide 60*a*, it first passes magnetism sensor 61*b'*, and then it passes opening P, where illuminating strobe 61*c'* lights the ball so that color identification sensor 61*d'* can detect the color of the ball. Communication unit 61*e'* transmits the magnetic and color information to the central information control device 7, which matches this ball identification information with the particular tee box 5 from which it came. The central information control device 7 relays the first prize information to the terminal device 16 of the particular tee box 5, which flashes first prize lamp 162 of the terminal device 16 and displays the prize information on LCD display 167. The amount or value of this first prize depends on the distance of the standing target 50 from the tee boxes. If the golfer strikes a golf ball such that it flies as described by parabola dashed line B2 or B3, the ball is similarly identified as a second or third prize winning ball. After being identified as a winning ball, the ball passes through one of the exit holes 62*a*–62*c* into gutter section 3*b* of gutter system 3, which carries the ball to the ball processing and distribution center 4.

The value of each prize is calculated according to a predetermined formula. The formula is determined for each driving range to maintain interest in the game. For example, if the golfer hits the standing target 50 at maximum distance of 190 yards, the first prize may be worth 50 balls, second prize 30 balls, and third prize 10 balls. If the standing target 50 is moved closer to the tee boxes, then the value of the prizes may be adjusted downwardly by the central information control device 7 according to the predetermined formula.

By pushing prize ball claim button 168 on the terminal device 16, the predetermined number of prize balls are released from ball stock 12 into rented ball holding box 13. Alternatively, by pushing point registration button 169 on the terminal device 16, the golfer registers the prize point value into computer memory of the central information and control device 7. The accumulated prize points are shown on LCD display 167 of the terminal 16. The accumulated prize points can be recorded for credits on the pre-paid card by inserting the card into card insertion slot 160. In case accumulated total point reaches a certain point, a golfer may select merchandise or cash prizes instead of practice balls. Thus, the game is designed to heighten the interest in golf driving range practice.

As previously described, the gutter system 3 moves golfs balls to the collection tank 4*a* of ball processing and distribution center 4. Batches of balls from the collection tank 4*a* are moved through the washing and drying machine 9, then to ball storage 10, from where they are lifted to the ball distribution system 4*b*, which automatically identifies and distributes the balls back to the ball stock 12 of each tee box 5.

Second Embodiment

Referring to FIGS. 15 through 23, a second embodiment of the golf driving range system is illustrated. The structure and operation of the driving range system of the second embodiment is substantially the same as in the first embodiment, thus, only the important differences are described with respect to the second preferred embodiment.

According to the second embodiment of the invention, instead of being identified by magnetism and color, a simple pattern of markings printed or painted on a golf ball are identified with modern optical character recognition devices. This technology is advanced to the point where a computer can take a video image and decipher various codes, symbols, or other markings.

Figure 15:
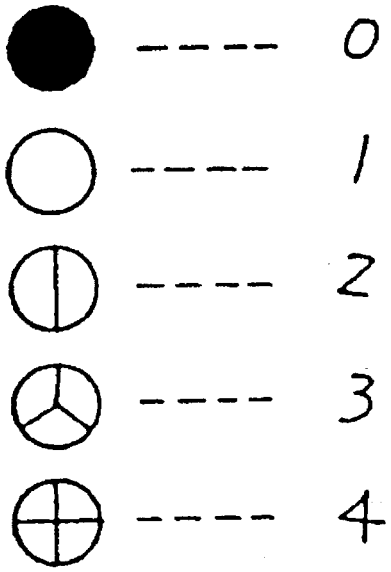
FIG. 15 is a table of symbols that can be used to mark golf balls so that they can be identified by optical character recognition technology.
Figure 16A:
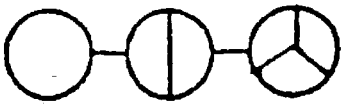
FIGS. 16*a* and 16*b* are illustrations of three symbols in a row as they would be applied to a golf ball to identify the ball.
Figure 16B:
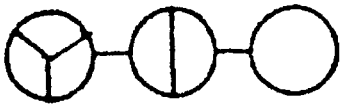

For example, referring to FIG. 15 of the drawing, a solid black circular symbol can represent the numeral zero; a solid white circular symbol can represent the numeral one; a single dividing line symbol can represent the numeral 2, a three-way dividing line symbol can represent the numeral three; and a four-way dividing line symbol can represent the numeral four. Thus, referring to FIG. 16*a*, the three symbols shown represent the sequence of numerals "one-two-three." Referring to FIG. 16*b*, the opposite sequence of symbols represent the sequence of numerals "three-two-one." For simplicity, since the symbols on a golf ball may be oriented in any direction, the order of the symbols from left-to-fight or from fight-to-left is considered equivalent. Therefore, "one-two-three" is considered to be the same as "three-two-one." There are 125 different possible combinations of three of the five circular symbols shown in FIG. 15. But since the combinations are read to be identical either from left-to-right or from right-to-left, that means there are 75 different possible reversible combinations.

Figure 17:
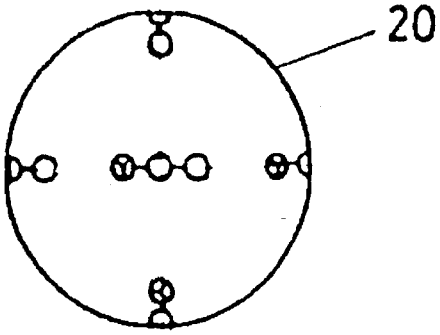
FIGS. 17 is an illustration of a golf ball having several of the symbols printed or painted on the surface so that the ball can be identified by optical character recognition technology from any direction.

FIG. 17 illustrates a golf ball 20 having these types of symbols printed or painted thereon. The symbols are preferably repeated at six different places on the surface of the golf ball 20 so that at least one of the symbols can be read regardless of the orientation of the ball. For example, the ball 20 has the symbols "three-one-one" or "one-one-three" printed or painted thereon. This identification information can be used to correlate the balls having these particular symbols with one particular tee box 5 of tee-box facility 1, for example, the thirteenth box on the first floor. The symbols are preferably applied with indelible ink that resists fading or marring. Furthermore, the ball is preferably covered with a clear protective coating or hardened by ultraviolet light treatment.

It is to be understood, of course, that the particular symbols or markings used in the invention are not critical. The symbols are preferably relatively simple to facilitate recognition by the optical character recognition devices. However, optical character recognition technology can be used to identify almost any mark, letter, symbol, bar code, and any combination of these.

Figure 18:
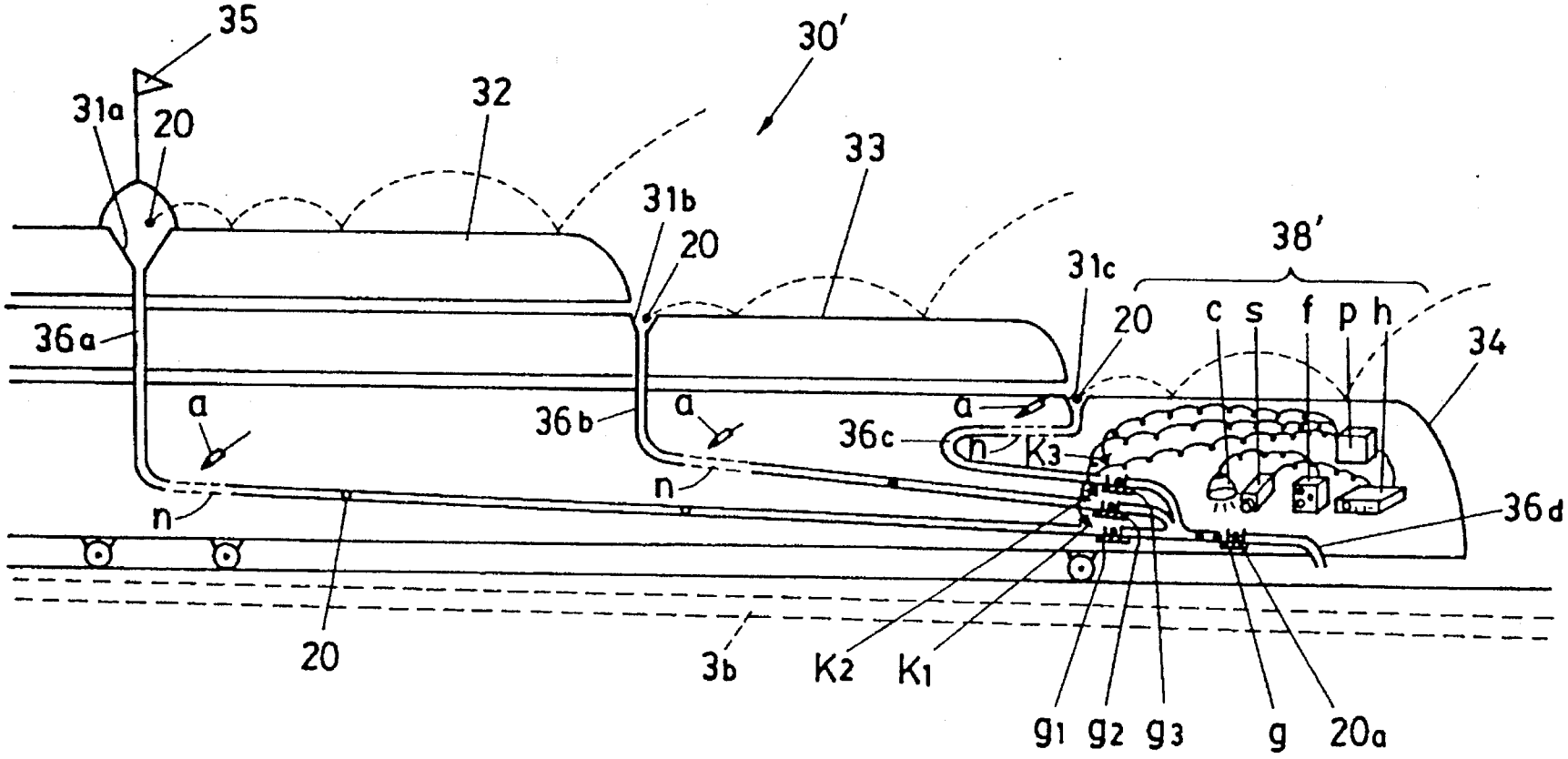
FIG. 18 is a cross-section illustration of a modified green target that uses optical character recognition devices to identify a winning ball.
Figure 19:
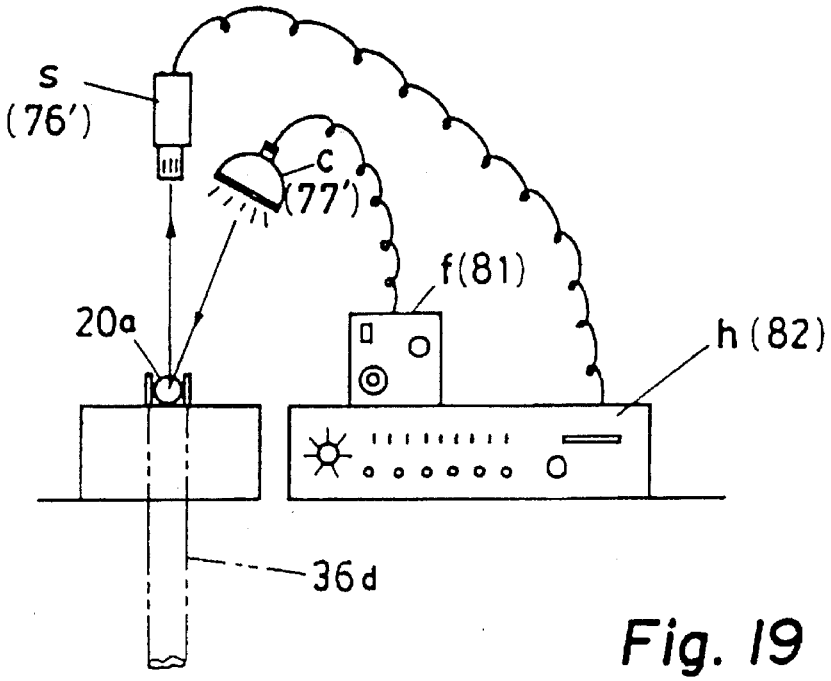
FIG. 19 is a front view of one embodiment of an optical character recognition device for reading the symbols printed or painted on a golf ball.
Figure 20:
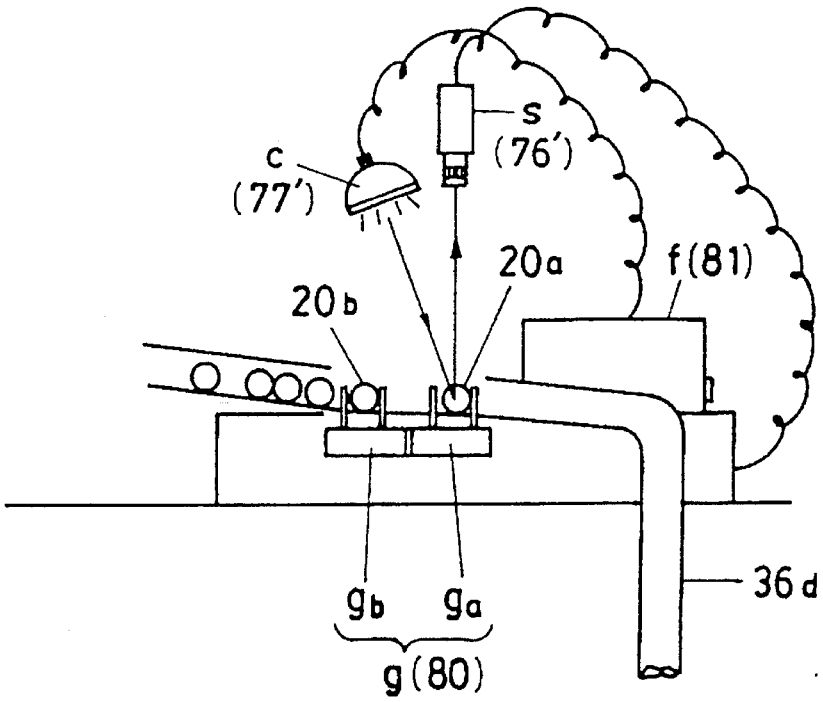
FIG. 20 is a side view of the optical character recognition device shown in FIG. 19.

The optical character recognition apparatus for winning ball identification system 38' of a modified green target 30' is illustrated in FIGS. 18–20. FIG. 18 is a cross-section illustration of a modified green target 30', which is similar to previously described green target 30 in the first embodiment, except that instead of using magnetism and color sensing devices to identify a winning ball, it uses optical character recognition devices. FIG. 19 shows a front view of an optical character recognition device as applied to the present invention; and FIG. 20 shows a side view of the optical character recognition device shown in FIG. 19.

On modified green target 30', a ball 20 drops into prize hole 31*a* or prize gutters 31*b* or 31*c* and rolls down through one of the sloped ball guide 36*a*–36*c* to a collection ball guide 36d. The modified green target 30' has a winning ball identification system 38', which includes several components aligned with the ball guides 36*a*–36*c* and 36*d*.

According to the modified winning ball identification system 38', a ball cleaner unit 38*a'* is positioned adjacent a wire net portion of each ball guide 36*a*–36*c*. The ball cleaner unit cleans dust, dirt, rain water, etc. from the surface of a ball 20 by blowing compressed air toward the ball as it passes through wire net portion N of a ball guide 36*a*–36*c*. Cleaning the ball with unit 38*a* before it reaches the optical character recognition device 38*s* is desirable to obtain accurate symbol recognition.

Ball stoppage devices g1, g2, and g3 are positioned in line with each ball guide 36*a*–36*c*, respectively, to temporarily arrest a ball in the ball guide. Ball sensors K1, K2, and K3 are positioned adjacent each ball stoppage device g1, g2, and g3, respectively. Ball sensors K1, K2, and K3 detect the presence of a ball in the adjacent ball stoppage device. The ball sensors K1–K3 can be optical sensors, micro switches, or contact sensors that detect the presence of a ball 20. Once a ball is detected, the ball sensor K1, K2, or K3 sends a signal to controller 38*p*, which then transmits the prize class information to computer processor 38*h*. Once the prize class information has been determined, the computer controller 38*p* instructs the appropriate ball stoppage device g1, g2, or g3, to release the ball so that it can continue through the ball guide 36*a*, 36*b*, or 36*c*.

After a ball is released from one of the ball stoppage devices g1, g2, or g3, it passes from ball guide 36*a*–36*c* into the collection ball guide 36*d*. Having all the winning balls from the different tiers of the green target 30' pass through a single collection conduit 36*d*, less optical character recognition equipment is required. The use of a collection ball guide 36*d* can be employed with respect to the winning ball identification system previously discussed and shown in FIG. 8, which reduces the number of magnetism and color detectors required.

To identify the symbols printed or painted on the surface of golf ball 20, it is momentarily stopped by ball stoppage device g in collection ball guide 36*d* in front of sensor camera 38*s*. An illumination strobe 38*c* strongly illuminates a ball 20*a* as it rests in stoppage device g so that an optical character recognition device 38*s* can take a video image of the symbols printed or painted on a golf ball 20*a* in the ball stoppage device g. An image checking device 38*f* digitizes, rotates and adjusts the video image for optimum character recognition. Computer processor 38*h* performs the character recognition function, comparing the symbols of the video image symbol with the symbol images stored in computer memory. The computer processing device 38*h* sends the prize class information and the ball identification information to central information processing device 7. Once the identity of the ball is determined, the computer processing device 38*h* sends a signal to controller 38*p*, which instructs the ball stoppage device g to release the ball 20*a* so that it can continue through the ball guide 36*d* to be dropped into the gutter section 3*b* of gutter system 3.

According to one preferred embodiment of the invention, the processing device 36*h* does not allow the controller 38*p* to release another ball from any of the stoppage devices g1, g2, or g3 until it has identified the ball 20*a* and released the ball from stoppage device g. This provides good control over the flow of balls through the winning ball identification system 38' such that the prize information and identification of the winning ball are properly correlated.

According to a most preferred embodiment of the invention, each ball stoppage device preferably further comprises two ball stoppage units. For example, referring to FIGS. 19 and 20 of the drawing, ball stoppage device g preferably includes ball stoppage units ga and gb. Ball stoppage units ga stops a ball 20*a* in front of camera 38*s*, and ball stoppage unit gb stops the following ball 20*b*. The ball 20*b* is not released until the ball 20*a* has been identified and released. The dual stopping units ga and gb provide enhanced flow control of the balls through the winning ball identification system 38'.

The time required for optical character recognition devices is currently about one to two seconds. Thus, the computer processing device 38*h* preferably also has a timer so that if the ball cannot be identified for any reason within a suitable period, three seconds for example, it releases the ball anyway so as not to hold up the game.

Figure 21:
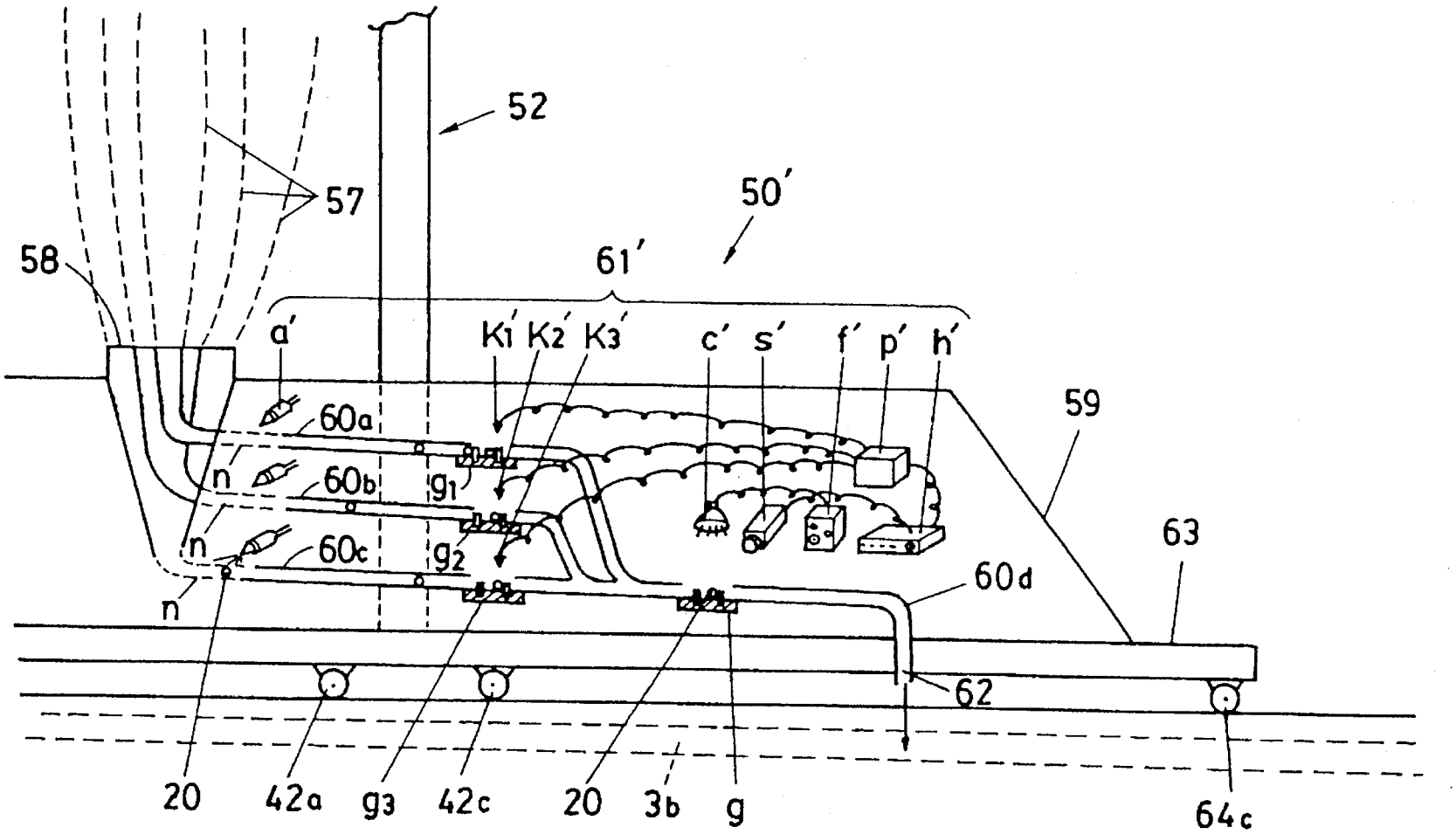
FIG. 21 is a cross-section illustration of a modified standing target that uses optical character recognition devices to identify a winning ball.

The optical character recognition apparatus for winning ball identification system 61' of a modified standing target 50' is illustrated in FIGS. 21. Modified standing target 50' is similar to previously described standing target 50 in the first embodiment, except that instead of using magnetism and color sensing devices to identify a winning ball, it uses optical character recognition devices.

On modified standing target 50', a winning ball 20 drops down and into through one of the sloped ball guides 60*a*–60*c* to a collection ball guide 60*d*. The modified standing target 50' has a winning ball identification system 61', which includes several components aligned with the ball guides 60*a*–60*c* and 60*d*.

According to the modified winning ball identification system 61', a ball cleaner unit 61*a'* is positioned adjacent to a wire net portion of each ball guide 60*a*–60*c*. The ball cleaner unit 61*a'* cleans dust, dirt, rain water, etc. from the surface of a ball 20 by blowing compressed air toward the ball as it passes through wire net portion N of a ball guide 60*a*–60*c*. Cleaning the ball with unit 61*a'* before it reaches the optical character recognition device 61*s'* is desirable to obtain accurate symbol recognition.

Ball stoppage devices g1, g2, and g3 are positioned in line with each ball guide 60*a*–60*c*, respectively, to temporarily arrest a ball in the ball guide. Ball sensors K1, K2, and K3 are positioned adjacent each ball stoppage device g1, g2, and g3, respectively. Ball sensors K1, K2, and K3 detect the presence of a ball in the adjacent ball stoppage device. The ball sensors K1–K3 can be optical sensors, micro switches, or contact sensors that detect the presence of a ball 20. Once a ball is detected, the ball sensor K1, K2, or K3 sends a signal to controller 61*p'*, which then transmits the prize class information to computer processor 61*h'*. Once the prize class information has been determined, the computer controller 61*p'* instructs the appropriate ball stoppage device g1, g2, or g3, to release the ball so that it can continue through the ball guide 60*a*, 60*b*, or 60*c*.

After a ball is released from one of the ball stoppage devices g1, g2, or g3, it passes from ball guide 60*a*–60*c* into the collection ball guide 60*d*. Having all the winning balls from the different openings of the standing target 50' pass through a single collection conduit 60*d*, less optical character recognition equipment is required. The use of a collection ball guide 60*d* can be employed with respect to the winning ball identification system previously discussed and shown in FIG. 11, which reduces the number of magnetism and color detectors required.

To identify the symbols printed or painted on the surface of golf ball 20, it is momentarily stopped by ball stoppage device g in collection ball guide 60*d* in front of sensor camera 61*s'*. An illumination strobe 61*c'* strongly illuminates a ball 20*a* as it rests in stoppage device g so that an optical character recognition device 61*s'* can take a video image of the symbols printed or painted on a golf ball 20*a* in the ball stoppage device g. An image checking device 61*f'* digitizes, rotates and adjusts the video image for optimum character recognition. Computer processor 61*h'* performs the character recognition function, comparing the symbols of the video image symbol with the symbol images stored in computer memory. The computer processing device 61*h'* sends the prize class information and the ball identification information to central information processing device 7. Once the identity of the ball is determined, the computer processing device 61*h'* sends a signal to controller 61*p'*, which instructs the ball stoppage device g to release the ball 20*a* so that it can continue through the ball guide 60*d* to be dropped into the gutter section 3*b* of gutter system 3.

Figure 22:
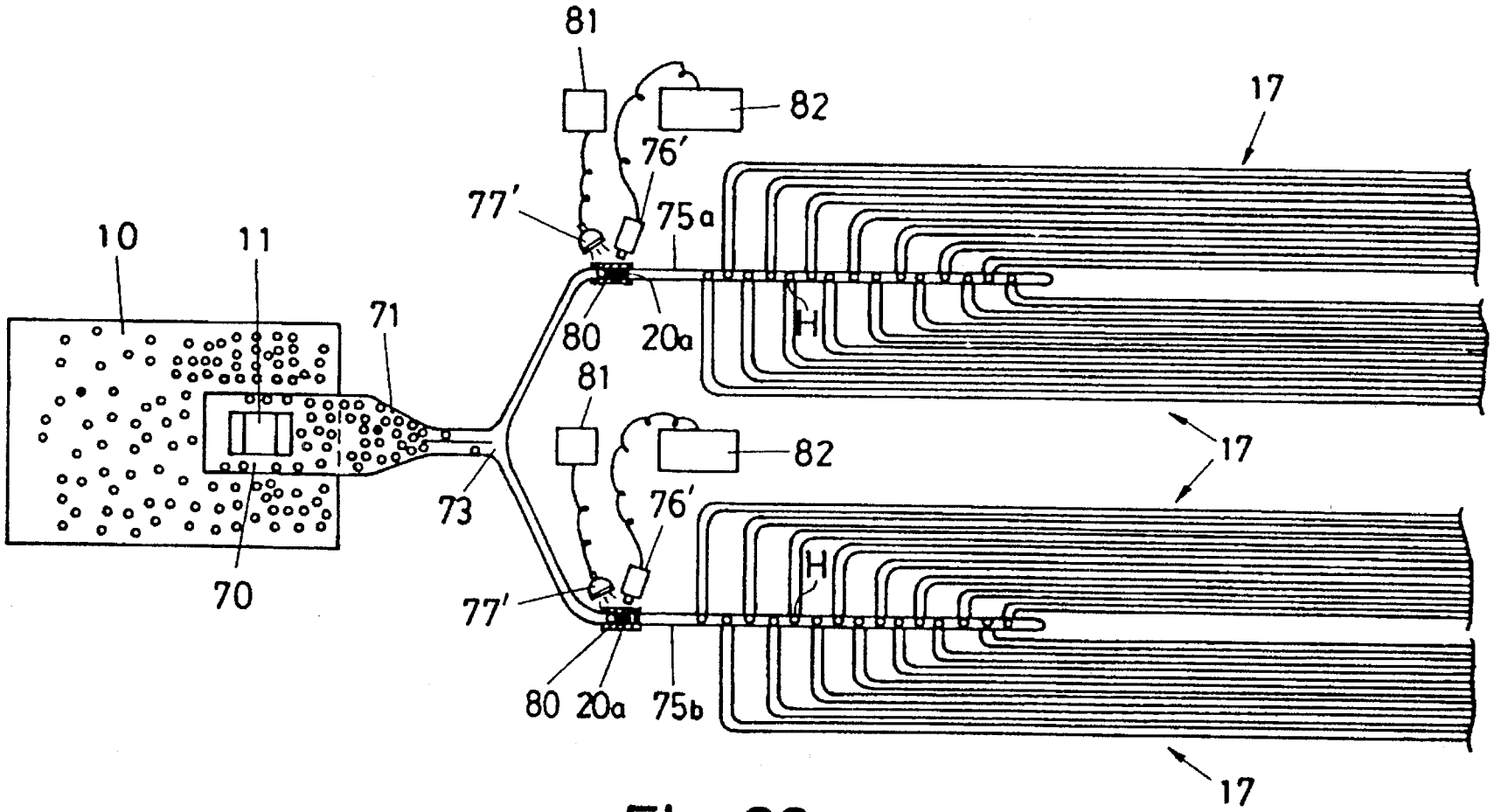
FIG. 22 is a plan view of a ball distribution system that uses optical character recognition devices to identify a ball for distributing the golf balls to the individual tee boxes of the tee-box facility after they have been collected by the gutter system of the yard.

Referring now to FIG. 22 of the drawing, a modified ball distribution system 4*b'* is shown, which is substantially the same as the ball distribution system 4*b* previously described except for the use of optical recognition devices to identify the golf balls. Golf balls are carried upward from ball storage 10 by ball elevator 11 to ball holder 70 of ball distribution system 4*b'*. The bottom of the ball holder 70 is sloped so that the balls move downwardly toward triangular ball guide passage 71. In this embodiment of the invention, the lower exit passage of ball guide passage 71 has a forked path 73. At fork 73 all balls are arbitrarily diverted between an upper distribution conduit 75*a* and a lower distribution conduit 75*b*, approximately half and half. Upper and lower distribution conduits 75*a* and 75*b*, respectively, are preferably slightly sloped so that a ball rolls therethrough.

As a ball rolls through upper distribution conduit 75*a*, it is stopped by ball stoppage device 80. An optical character recognition camera 76 takes an image of a ball illuminated by illumination strobe 77. Binary image checking device 82 applies rotation and position adjustment to the image to facilitate comparison with images stored in memory. According to the identification information on the ball, the central computing device 7 opens a particular drop hole H and a ball drops into ball distribution pipe 17 which goes to tee box to which the the ball belongs.

Because so much more ball identification information can be placed on a ball to be recognized by optical character recognition technology, it is not necessary to use magnetism to distinguish between the balls intended for the upper and lower floors of the tee-box facility 1. For example, if desired, each golf ball can be uniquely identified with a bar code or other symbolic identification. The central information control device 7 can keep track of each uniquely identified ball and temporarily relate the unique ball information to a particular tee box. The next time through the system, the ball can be related to a different tee box.

The above-mentioned ball temporary stoppage device 80 preferably consists of two ball stoppage units. While a ball 20*a* is temporary stopped in front of camera 76' by ball stoppage unit ga the following ball 20*b* is kept being stopped by upstream ball stoppage unit gb. Upon completion of the ball identification process a ball 20*a* is released from ball stoppage unit ga and next ball 20*b* is transferred from ball stoppage unit gb to ga.

Although the invention has been described with reference to these preferred embodiments, other embodiments can achieve the same results. Variations and modifications of the present invention will be apparent to those skilled in the art without departing from the scope and spirit of the invention, and it is intended to cover in the appended claims all such modifications and equivalents.

Having described the invention, what is claimed is:

1. A golf driving range system for golfers to practice their driving skills, the system comprising: a plurality of tee boxes, each tee box having a renewable ball stock and an automatic golf ball tee-up machine, the balls in said ball stock having identifying characteristics for relating the balls to a particular tee box; a yard and ball return gutters, said yard having sloped surfaces to cause any golf balls landing on said surfaces to roll toward said ball return gutters; at least one target in said yard, said target having a winning ball identification apparatus for sensing the identifying characteristics of a ball hitting the target and relaying this information to a scoring device; and a ball distribution apparatus operably connected to said ball return gutters, said ball distribution apparatus having a return ball identification apparatus for sensing the identifying characteristics of a ball and distributing the ball back to said renewable ball stocks of said tee boxes.

2. A golf driving range system according to claim 1, wherein the identifying characteristics for the golf balls include color, and said winning and return ball identification apparatuses include a color sensor.

3. A golf driving range system according to claim 1, wherein the identifying characteristics for the golf balls include graphic symbols, and said winning and return ball identification apparatuses include an optical character recognition device.

4. A golf driving range system according to claim 1, wherein the identifying characteristics for the golf balls include a bar code, and said winning and return ball identification apparatuses include a bar code reader.

5. A golf driving range system according to claim 1, wherein said target has at least a first place target zone that is generally circular, a second place target zone that is generally circular and concentrically disposed around said first target zone, and a third place target zone that is generally circular and concentrically disposed around said second place target zone.

6. A golf driving range system according to claim 5, wherein each of said first, second, and third target zones of said target has a ball collection means for delivering a ball to said winning ball identification apparatus.

7. A golf driving range system according to claim 6, wherein each of said ball collection means includes a ball sensor for detecting the presence of a ball passing therethrough, whereby said ball sensor determines which target zone the ball entered and the winning ball identification apparatus identifies the ball as relating to a particular tee box.

8. A golf driving range system according to claim 7, wherein said scoring device provides prize information to a golfer in a particular tee box for a ball reaching one of said first, second, or third target zones of said target.

9. A golf driving range system for golfers to practice their driving skills, the system comprising: a plurality of tee boxes, each tee box having a renewable ball stock and an automatic golf ball tee-up machine, the balls in said ball stock having identifying characteristics for relating the balls to a particular tee box; a yard and ball return gutters, said yard having sloped surfaces to cause any golf balls landing on said surfaces to roll toward said ball return gutters; at least one target in said yard, said target having a winning ball identification apparatus for sensing the identifying characteristics of a ball hitting the target and relaying this information to a scoring device; and a ball distribution apparatus operably connected to said ball return gutters, said ball distribution apparatus having a return ball identification apparatus for sensing the identifying characteristics of a ball and distributing the ball back to said renewable ball stocks of said tee boxes, wherein the identifying characteristics for the golf balls includes the presence or absence of magnetism, and said winning and return ball identification apparatuses include a magnetism sensor.

10. A golf driving range system for golfers to practice their driving skills, the system comprising: a plurality of tee boxes, each tee box having a renewable ball stock and an automatic golf ball tee-up machine, the balls in said ball stock having identifying characteristics for relating the balls to a particular tee box; a yard and ball return gutters, said yard having sloped surfaces to cause any golf balls landing on said surfaces to roll toward said ball return gutters; at least one movable target movably mounted on a track in said yard, said movable target having a winning ball identification apparatus for sensing the identifying characteristics of a ball hitting the target and relaying this information to a scoring device; and a ball distribution apparatus operably connected to said ball return gutters, said ball distribution apparatus having a return ball identification apparatus for sensing the identifying characteristics of a ball and distributing the ball back to said renewable ball stocks of said tee boxes.

11. A golf driving range system according to claim 10, wherein said movable target is mounted generally horizontally, whereby said target simulates a generally horizontal golf green.

12. A golf driving range system according to claim 10, wherein said movable target is mounted substantially vertically to simulate a golf green at a greater than actual distance from the tee boxes.

13. A golf driving range system for golfers to practice their driving skills, the system comprising: a plurality of tees, each tee having a renewable ball stock, the balls in said ball stock having identifying characteristics for relating the balls to a particular tee; a yard, said yard having at least one ball return gutter; at least one target in said yard, said target having a winning ball identification apparatus for sensing the identifying characteristics of a ball entering the target and relaying this information to a scoring device; said target having at least one ball guide for transferring a winning ball to said ball return gutter in said yard; and a ball distribution apparatus operably connected to said ball return gutter, said ball distribution apparatus having a return ball identification apparatus for sensing the identifying characteristics of a ball and distributing the ball back to said renewable ball stocks of said tees.

14. A golf driving range system according to claim 13, wherein said yard has sloped surfaces to cause a golf ball landing on said surfaces to roll toward said ball return gutter.

15. A golf driving range system according to claim 13, wherein said tee is provided with a tee box having an automatic tee-up machine.

16. A golf driving range system according to claim 13, wherein said target is movably mounted on a track on said yard.

17. A golf driving range system according to claim 16, wherein further comprising a motorized drive assembly for moving said movable target along said track.

18. A golf driving range system according to claim 17, further comprising a remote controller for selectively operating said motorized drive assembly to selectively change the distance of said movable target from said tee boxes.

19. A golf driving range system according to claim 16, wherein said movable target further comprises: a first circular frame defining a first place target zone that is generally circular, a second circular frame defining a second place target zone that is generally circular and concentrically disposed around said first target zone, and a third circular frame defining a third place target zone that is generally circular and concentrically disposed around said second place target zone.

20. A golf driving range system according to claim 19, wherein said target is vertical and said first, second, and third circular frames each support a netting structure for capturing a golf ball entering the first place, second place, or third place target zones, respectively, each of said netting structures being connected to a first place, second place, and third place receiving gutter, respectively, whereby said netting structures guides a golf ball entering said first place, said second place, or said third place target zones to said first place, said second place, or said third place receiving gutter, respectively, said receiving gutters being operably connected to said at least one ball guide.

21. A golf driving range system according to claim 20, wherein said winning ball identification apparatus has separate apparatus for sensing the identifying characteristics of a ball guided into said first place, said second place, or said third place receiving gutter, respectively, and for relaying the identification characteristics of the ball to a scoring device.

* * * * *

United States Patent and Trademark Office
CERTIFICATE OF CORRECTION

PATENT NO. : 5,513,841

DATED : May 7, 1996

INVENTOR(S) : Hideaki Takagi

It is certified that errors appear in the above-identified patent and that said Letters Patent is hereby corrected as shown below:

In Column 1, line 47, change "golfers" to -- golfer's --;

In Column 7, line 2, "7a–7a" should be -- 7a–7e --;

In Column 9, line 11, "46" should be -- 48 --;

In Column 9, line 48, "controller48" should be -- controller 48 --'

In Column 11, line 47,"61 c "should be--61c--.

In Column 16, line 17, "left-to-fight" should be -- left-to-right --;

In Column 16, line 18, "left-to-fight" should be --left-to-right --.

Signed and Sealed this

Thirteenth Day of August, 1996

*Attest:*

Bruce Lehman

BRUCE LEHMAN

*Attesting Officer*

*Commissioner of Patents and Trademarks*